US012778317B2

(12) United States Patent
Hu et al.

(10) Patent No.: US 12,778,317 B2
(45) Date of Patent: Nov. 3, 2026

(54) MOUNTING BASE, CONNECTING BASE, AND CHILD CONTAINMENT DEVICE

(71) Applicant: WONDERLAND SWITZERLAND AG, Steinhausen (CH)

(72) Inventors: Junjie Hu, Dongguan (CN); Qingmei Tan, Dongguan (CN); Huan Yin, Dongguan (CN); Wenqu Hu, Dongguan (CN); Tao Wang, Dongguan (CN)

(73) Assignee: Wonderland Switzerland AG, Steinhausen (CH)

( * ) Notice: Subject to any disclaimer, the term of this patent is extended or adjusted under 35 U.S.C. 154(b) by 32 days.

(21) Appl. No.: 18/743,534

(22) Filed: Jun. 14, 2024

(65) Prior Publication Data

US 2024/0415295 A1 Dec. 19, 2024

(30) Foreign Application Priority Data

Jun. 16, 2023 (CN) ..... 202310725360.7
Aug. 9, 2023 (CN) ..... 202311002157.3
Jun. 12, 2024 (CN) ..... 202410756430.X

(51) Int. Cl.
*A47D 13/06* (2006.01)

(52) U.S. Cl.
CPC ..... *A47D 13/066* (2013.01)

(58) Field of Classification Search
CPC ..... A47D 13/06; A47D 13/063; A47D 13/061
USPC ..... 5/93.1
See application file for complete search history.

(56) References Cited

U.S. PATENT DOCUMENTS

| | | | | |
|---|---|---|---|---|
| 2,415,186 | A | 2/1947 | Moore | |
| 6,192,535 | B1 | 2/2001 | Warner, Jr. et al. | |
| 7,346,943 | B2 * | 3/2008 | Chen | A47D 7/03 5/93.1 |
| 7,458,114 | B2 * | 12/2008 | Troutman | A47D 9/016 5/93.1 |
| 9,078,530 | B2 * | 7/2015 | Ingram | A47D 13/06 |
| 9,351,587 | B2 * | 5/2016 | Burns | A47D 13/06 |
| 10,952,544 | B2 * | 3/2021 | Sclare | A47D 5/00 |

(Continued)

FOREIGN PATENT DOCUMENTS

| | | |
|---|---|---|
| CN | 1153537 C | 6/2004 |
| CN | 101366585 A | 2/2009 |

(Continued)

OTHER PUBLICATIONS

Taiwan Patent Office. Office Action for corresponding application TW 114124050, mailed Aug. 27, 2025. 11 pages. Partial English translation included.

(Continued)

*Primary Examiner* — J. T. Newton
(74) *Attorney, Agent, or Firm* — Volpe Koenig

(57) ABSTRACT

The present application provides a mounting base, a connecting base, and a child containment device. The mounting base is adapted to be mounted on a child containment body. The mounting base includes at least two first connecting parts, and each of the at least two first connecting parts is adapted to be connected to a second connecting part of a connecting base of a carrier accessory, so that the mounting base is capable of connecting to at least two carrier accessories simultaneously.

18 Claims, 27 Drawing Sheets

(56) References Cited

U.S. PATENT DOCUMENTS

| | | | | |
|---|---|---|---|---|
| 12,066,319 | B2 * | 8/2024 | Eggert-Crowe | A47D 5/00 |
| 2006/0225205 | A1 * | 10/2006 | Troutman | A47D 5/00 24/72.5 |
| 2014/0191173 | A1 * | 7/2014 | Saint | A47D 13/06 256/25 |
| 2015/0282640 | A1 * | 10/2015 | Burns | A47D 13/063 5/655 |
| 2016/0270551 | A1 * | 9/2016 | Burns | A47D 5/00 |
| 2016/0286978 | A1 * | 10/2016 | Sclare | A47D 9/016 |
| 2017/0196373 | A1 * | 7/2017 | Sclare | A47D 13/063 |
| 2020/0386367 | A1 | 12/2020 | Hung | |

FOREIGN PATENT DOCUMENTS

| | | | |
|---|---|---|---|
| CN | 202775309 | U | 3/2013 |
| CN | 104367038 | A | 2/2015 |
| CN | 206119796 | U | 4/2017 |
| CN | 104367038 | B | 9/2018 |
| CN | 109393840 | A | 3/2019 |
| CN | 109567483 | A | 4/2019 |
| WO | 2016035062 | A1 | 3/2016 |
| WO | 2021226598 | A1 | 11/2021 |

OTHER PUBLICATIONS

"Extended European Search Report Issued in Corresponding European Patent Application No. 24182598.3", Mailed Date: Oct. 18, 2024, 8 pages.

"Office Action Issued in Corresponding United Kingdom Patent Application No. GB2408562.3", Mailed Date: Dec. 16, 2024, 10 pages.

"Office Action Issued in Corresponding Taiwanese Patent Application No. 113122215", Mailed Date: Dec. 30, 2024, 33 pages.

* cited by examiner

MOUNTING BASE, CONNECTING BASE, AND CHILD CONTAINMENT DEVICE

CROSS-REFERENCE TO RELATED APPLICATIONS

This application claims priorities under 35 U.S.C. 119 from Chinese Patent Application No. 202310725360.7, entitled "CHILD CONTAINMENT DEVICE" and filed on Jun. 16, 2023, Chinese Patent Application No. 202311002157.3, entitled "MOUNTING BASE, CONNECTING BASE, CARRIER ACCESSORY, CHILD CONTAINMENT DEVICE AND ASSEMBLY" and filed on Aug. 9, 2023, and Chinese Patent Application No. CN202410756430.X, entitled "MOUNTING BASE, CONNECTING BASE, AND CHILD CONTAINMENT DEVICE" and filed on Jun. 12, 2024, the contents of which are incorporated herein by reference in their entireties.

TECHNICAL FIELD

The present application relates to a mounting base, a connecting base, and a child containment device.

BACKGROUND

Child containment devices (e.g., children's playpens, cribs, etc.) can provide infants and toddlers with a safe and comfortable play and rest area. Typically, the child containment devices can also be equipped with various child carrier accessories (such as changing tables, sleeping baskets, etc.) to enhance their functionality. The child carrier accessories can be detachably connected to the handrail of the child containment device, allowing them to be installed on or removed from the child containment device as needed.

To facilitate the parents in caring for the infants and toddlers, the child containment devices can also be equipped with storage baskets where items such as diapers and clothing can be placed. The storage basket in the related art is usually attached to the top edge (e.g., the handrail) of the child containment device. However, after the storage basket is attached to the child containment device, it may hinder the installation of the child carrier accessories, causing inconvenience to users.

Furthermore, currently, various carrier accessories are detachably mounted on the handrails using their respective mounting bases. When the child containment body needs to be equipped with multiple carrier accessories, each carrier accessory is connected to the handrail via its mounting base. This results in a large number of mounting bases being mounted on the handrail, making the entire product (i.e., the child containment assembly) bulky and costly. In cases where the child containment device needs to be equipped with only one carrier accessory, other carrier accessories and their mounting bases need to be stored, and poor storage may lead to the loss of mounting bases, affecting the installation of other carrier accessories in the future.

SUMMARY

In the first aspect of the present application, a child containment device is provided to address at least a part of the issues existed in the prior art child containment device as described above.

The first aspect of the present application provides a child containment device which includes a containment body, at least one first connecting member, and a storage basket. The containment body includes at least one side face enclosing a containment space. The at least one side face has a top edge defining a top opening of the containment space. The at least one first connecting member is disposed at the at least one side face. Each of the at least one first connecting member is located lower than a top edge of corresponding one of the at least one side face. The storage basket includes a storage body and at least one second connecting member connected to the storage body. The at least one second connecting member is connected to the at least one first connecting member such that the storage body is located at an outer side of the at least one side face.

Further, a top of the storage basket is lower than the top edge of the side face adjacent to the storage basket, and/or the at least one first connecting member is detachably connected to the at least one second connecting member.

Further, the containment body includes at least one connecting post. Each first connecting member includes a first housing part configured to house the corresponding connecting post such that each first connecting member is connected to the corresponding connecting post.

Further, the connecting post has an outer wall surface fitting against an inner wall surface of the first housing part.

Further, the outer wall surface of the connecting post has an arched region.

Further, the containment body includes an enclosing fabric and at least one joint member connected to the enclosing fabric. The connecting post defines an accommodating cavity and has an outer wall surface and an inner wall surface opposite to each other. The inner wall surface is provided with a first engagement opening. The joint member is located in the accommodating cavity and engaged with the first engagement opening such that the enclosing fabric is connected to the connecting post.

Further, the enclosing fabric includes at least one enclosing fabric piece connected to the at least one joint member. The inner wall surface includes at least one guiding surface configured to guide an extending direction of the at least one enclosing fabric piece.

Further, the at least one enclosing fabric piece includes two enclosing fabric pieces connected to a common joint member and forming an angle therebetween. The outer wall surface is arched in cross-section. The inner wall surface is trumpet-shaped in cross-section and has a port close to the outer wall surface. The port forms the first engagement opening. The inner wall surface includes two guiding surfaces located at two sides of the first engagement opening, respectively. The two guiding surfaces are in one-to-one correspondence to the two enclosing fabric pieces.

Further, the first housing part has a second engagement opening. The first housing part is detachably engaged with the connecting post through the second engagement opening.

Further, the containment body includes at least one enclosing fabric piece connected to the connecting post. The first connecting member includes at least one extending part that extends outward from at least on side of the second engagement opening.

Further, the containment body includes a support frame including a plurality of support legs. At least one of the plurality of support legs serves as the at least one connecting post, or the at least one connecting post is transversely connected between adjacent two of the support legs.

Further, a first positioning structure is provided between the first housing part and the connecting post. The first positioning structure is configured to secure the relative position of the first housing part to the connecting post.

Further, the first positioning structure includes: at least one first positioning protrusion provided on one of the first housing part and the connecting post, and at least one first positioning recess provided on the other one of the first housing part and the connecting post. The at least one first positioning protrusion and the at least one first positioning recess are detachably engaged with each other.

Further, the first housing part is slidable along the connecting post to allow adjustment of the relative position of the first housing part to the connecting post.

Further, the at least one first connecting member includes at least one second housing part for housing the at least one second connecting member.

Further, the at least one second connecting member includes at least one insertion slot. The storage basket includes a support rod connected to the storage body. The support rod includes the at least one second connecting member. The at least one second connecting member is detachably inserted into the corresponding insertion slot.

Further, the second housing part is provided with a stopping portion to limit the insertion depth of the second connecting member.

Further, a wall of the second housing part is provided with an elastic arm. A second positioning structure is provided between the elastic arm and the second connecting member to restrict the second connecting member from disengaging from the second housing part.

Further, the second positioning structure includes: at least one second positioning protrusion provided on one of the elastic arm and the second connecting member, and at least one second positioning recess provided on the other one of the elastic arm and the second connecting member. The at least one second positioning protrusion and the at least one second positioning recess are detachably engaged with each other.

Further, the containment body or the first connecting member includes a first limiting part. The storage body includes a second limiting part. The first limiting part and the second limiting part are detachably connected to restrict the movement of the storage body away from the side face of the containment body.

Further, the containment body includes an enclosing fabric. The first limiting part includes a first connecting ring connected to the enclosing fabric. The second limiting part includes a second connecting ring connected to the storage body. At least one of the first connecting ring and the second connecting ring can be opened to connect with the other one of the first connecting ring and the second connecting ring.

Further, the first limiting part includes at least one connecting strip provided on the least one first connecting member. The second limiting part includes a connecting ring or a connecting strap connected to the storage body. The connecting ring or the connecting strap wraps around the connecting strip. And/or, the first limiting part includes at least one first button provided on the at least one first connecting member, the second limiting part includes a second button connected to the storage body, the first button and the second button can be detachably engaged with each other.

Further, one end of the connecting strip is a fixed end, and the other end of the connecting strip is a free end with a protrusion.

Further, the containment body includes a support frame and an enclosing fabric connected to the support frame. The at least one first connecting member includes at least one fabric sleeve connected to the enclosing fabric.

Further, the storage basket includes a support rod. The storage body includes a connecting channel. A middle part of the support rod extends through the connecting channel, and two ends of the support rod are located outside the connecting channel and forming the second connecting members.

Further, the containment body includes a support frame and an enclosing fabric. The support frame includes at least one top corner member. The at least one first connecting member is positioned on an outer side of at least one top corner member.

Further, the top corner member is integrally formed with the first connecting member.

Further, the containment body includes a plurality of side faces. The storage body is positioned at an outer side of one of the side faces. The one of the side faces is provided with one first connecting member at each of two sides thereof.

Further, the storage body includes a first storage space and a second storage space arranged up and down and partitioned by a first partition. A top of the storage body has a first opening in communication with the first storage space. A side of the storage body has a second opening in communication with the second storage space. The second opening is located lower than the first opening.

Further, the storage body further includes a third storage space partitioned from both the first storage space and the second storage space. The first storage space and the second storage space are located at the same side of the third storage space. The first opening is in communication with the third storage space, and/or the side of the storage body has a third opening in communication with the third storage space.

Further, the containment body includes a support frame including a plurality of support legs. The at least one first connecting member includes at least one transverse rod connected between adjacent two of the support legs. The at least one second connecting member includes a connecting sleeve connected to the storage body. The connecting sleeve is sleeved onto the corresponding transverse rod.

The first aspect of the present application provides also provides a child containment device which includes a support frame including a plurality of support legs. At least adjacent two of the support legs are each provided with a first connecting member thereon. Each first connecting member is detachably connected to the corresponding support leg. The first connecting member is configured to connect with a storage basket. A first positioning structure is provided between each support leg and its corresponding first connecting member to secure the relative position of the support leg to the first connecting member.

Further, the first connecting member includes a first housing part for housing the support leg, the first housing part has a second engagement opening, and the first housing part is detachably engaged with the corresponding support leg through the second engagement opening; and/or the first positioning structure includes: at least one first positioning protrusion provided on one of the first housing part and the support leg; and at least one first positioning recess provided on the other one of the first housing part and the support leg.

Further, the first connecting member includes at least one extending part that extends outward from at least one side of the second engagement opening.

Further, the first connecting member can slide along the support leg to allow the adjustment of the relative position of the first connecting member to the support leg; and/or, the first connecting member is provided with a first limiting part for connecting to the storage body to restrict the movement of the storage body away from the side face of the containment body.

Further, the first connecting member includes a second housing part, which includes an insertion slot for housing the second connecting member of the storage basket. The wall body of the second housing part is provided with an elastic arm. The elastic arm is provided with a second positioning protrusion or a second positioning recess.

Further, the second housing part is provided with a stopping portion to limit the insertion depth of the second connecting member.

The first aspect of the present application further provides a child containment device which includes: a containment body including a support frame and an enclosing fabric connected to the support frame; at least one first connecting member including at least one fabric sleeve that is connected to the enclosing fabric and is used to connect with a storage basket; and at least one first limiting part that is connected to the enclosing fabric and is used to connect with the storage basket.

In the second aspect of the present application, a mounting base, a connecting base, a carrier accessory, and a child containment assembly are provided to address at least a part of the issues existed in the prior art child containment assembly as described above.

The second aspect of the present application provides a mounting base adapted to be mounted on a child containment body. The mounting base includes at least two first connecting parts. The at least two first connecting parts are adapted to be connected to second connecting parts of connecting bases of at least two carrier accessories such that the mounting base is capable of being connected to the at least two carrier accessories simultaneously.

Further, at least one of the first connecting parts is adapted to be detachably connected to corresponding one of the second connecting parts.

Further, each of the first connecting parts is adapted to be detachably connected to the corresponding one of the second connecting parts.

Further, at least one of the first connecting parts is adapted to be slidably connected to the corresponding one of the second connecting parts; and/or the mounting base is provided with at least one first limiting structure adapted to cooperate with a second limiting structure of the corresponding connecting base to restrict the relative position of the first connecting part to the second connecting part.

Further, the first connecting part includes a slide groove or a slide rail configured to slidably connect to the second connecting part. The slide groove or the slide rail extends in a first direction. The slide groove or the slide rail is shaped in cross-section to restrict the relative movement of the first connecting part to the second connecting part in a second direction perpendicular to the first direction.

Further, the mounting base includes two first connecting parts. Each of the first connecting parts includes a slide groove configured to slidably connect to the second connecting part. Each slide groove includes a base wall and a mounting port opposite to the base wall. The base walls of the slide grooves of the two first connecting parts are located close to each other. The mounting ports of the slide grooves of the two first connecting parts are located away from each other.

Further, each of the first connecting parts includes a slide groove configured to slidably connect to the second connecting part, and each slide groove includes a base wall and a mounting port opposite to the base wall; and/or the first limiting structure includes a limiting groove.

Further, the limiting groove is recessed relative to both a top wall of the mounting base and a side wall adjacent to the top wall of the mounting base.

Further, the child containment body includes a support member. The mounting base is adapted to be mounted on the support member. The support member is a handrail or a support rod connected to the handrail.

Further, the mounting base is adapted to be detachably connected to the support member.

Further, the mounting base includes: a shell formed with an engagement cavity for accommodating the support member, and a locking member connected to the shell and having a locking position and an unlocking position. When the locking member is in the locking position, the locking member is adapted to keep the support member in the engagement cavity. When the locking member is in the unlocking position, the locking member allows the mounting base to be disengaged from the support member.

Further, the locking member is pivotably connected to the shell. The locking member includes an unlocking part and at least one hook part. When the locking member is in the locking position, the at least one hook part is adapted to be stretched into the engagement cavity to engage with the support member. When the unlocking part is subjected to an unlocking force, the locking member rotates to the unlocking position such that the least one hook part is disengaged from the support member. The mounting base further includes a resilient member configured to keep the locking member in the locking position.

Further, the locking member is pivotably connected to the shell. The locking member includes at least one hook part. When the locking member is in the locking position, the at least one hook part is adapted to be stretched into the engagement cavity to engage with the support member. The shell is provided with an abutment part. When the locking member is in the locking position, the abutment part abuts against the at least one hook part to keep the locking member in the locking position.

Further, one of the shell and the locking member is provided with an elongated hole and the other one of the shell and the locking member is provided with a pivot shaft. The pivot shaft is mounted in the elongated hole. When the unlocking part is subjected to an unlocking force, the locking member rotates about the pivot shaft while the pivot shaft moves along the elongated hole to allow the hook part to disengage from the abutment part to move toward the unlocking position.

Further, the locking member includes a first hook part and a second hook part spaced apart from each other. The support member includes a plurality of tubes and a seat connected between adjacent two of the tubes. The mounting base is adapted to be mounted on the seat through the engagement cavity. The first hook part and the second hook part are adapted to be stretched into the engagement cavity to engage with the adjacent two of the tubes. The first hook part and the second hook part are adapted to be positioned at two sides of the seat. The first hook part and the second hook part cooperate with the seat to restrict the movement of the mounting base along the support member.

The second aspect of the present application further provides a child containment device including a child containment body and the mounting base as described above.

The second aspect of the present application further provides connecting base adapted to be mounted on a carrier frame of a carrier accessory. The connecting base includes a second connecting part. The second connecting part is adapted to be connected to one of the at least two first connecting parts of a mounting base on a support member of a child containment body.

Further, the second connecting part is adapted to be detachably connected to the corresponding first connecting part.

Further, the second connecting part is adapted to be slidably connected to the corresponding first connecting part; and/or the connecting base is provided with a second limiting structure adapted to cooperate with a first limiting structure of the mounting base to restrict the relative position of the second connecting part to the first connecting part.

Further, the second connecting part includes a slide groove or a slide rail configured to slidably connect to the first connecting part. The slide groove or the slide rail extends in a first direction. The slide groove or the slide rail is shaped in cross-section to restrict the relative movement of the second connecting part to the first connecting part in a second direction perpendicular to the first direction.

Further, the second connecting part includes a slide groove configured to slidably connect to the first connecting part. The slide groove includes a base wall and a mounting port opposite to the base wall.

Further, the second limiting structure includes an elastic arm and a limiting protrusion protruded from the elastic arm. The limiting protrusion is adapted to be engaged with a limiting groove of the first limiting structure.

Further, the elastic arm is further provided with an operating part configured to drive the elastic arm to rotate to allow the limiting protrusion to be disengaged from the corresponding limiting groove.

Further, the operating part is protruded from the elastic arm in a direction opposite to the protrusion direction of the limiting protrusion. The connecting base has a chamber for accommodating the operating part.

The second aspect of the present application further provides a carrier accessory including the connecting base as described above.

The second aspect of the present application further provides a mounting base adapted to be detachably connected to a support member of a child containment body. The mounting base includes a shell formed with an engagement cavity for accommodating the support member, and a locking member including a first hook part and a second hook part spaced apart from each other. When the locking member is in the locking position, the first hook part and the second hook part are adapted to enter the engagement cavity to engage with the support member to keep the support member in the engagement cavity. The first hook part and the second hook part are adapted to be positioned at two sides of a seat on the support member. The first hook part and the second hook part cooperate with the seat to restrict the movement of the mounting base along the support member.

Further, the shell is provided with at least one abutment part. When the locking member is in the locking position, at least one of the first hook part and the second hook part abuts against the at least one abutment part to keep the locking member in the locking position.

Further, one of the shell and the locking member is provided with an elongated hole and the other one of the shell and the locking member is provided with a pivot shaft. The pivot shaft is mounted in the elongated hole. When the locking member is subjected to an unlocking force, the locking member rotates about the pivot shaft while the pivot shaft moves along the elongated hole to allow the hook part to disengage from the abutment part to move toward the unlocking position.

Further, the locking member is pivotably connected to the shell. The locking member further includes an unlocking part. When the unlocking part is subjected to a force, the unlocking part drive the locking member to rotate to the unlocking position such that the first hook part and the second hook part are disengaged from the support member. The mounting base further includes a resilient member configured to keep the locking member in the locking position.

The second aspect of the present application further provides a child containment assembly including the child containment device as described above and at least one carrier accessory as described above.

BRIEF DESCRIPTION OF THE DRAWINGS

The accompanying drawings constituting a part of the present application are used to provide further understanding of the present application, and the exemplarily embodiments and descriptions thereof are used to explain the present application, and do not constitute an improper limitation of the present application.

DETAILED DESCRIPTION

Figure 1:
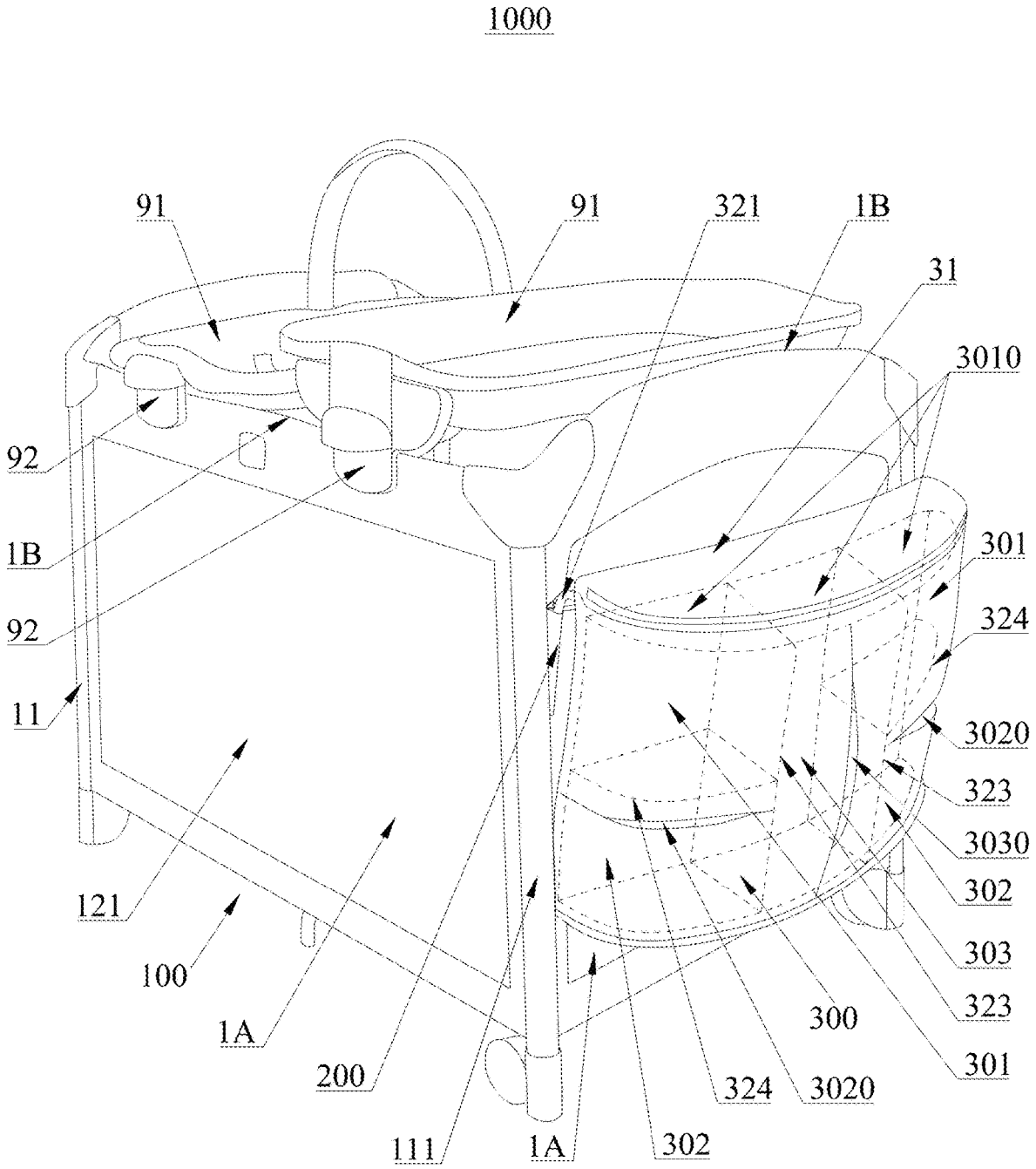
FIG. 1 schematically illustrates a perspective view of a child containment device equipped with two child support accessories according to a first embodiment in a first aspect of the present application.

FIG. 1 schematically illustrates a structure of a child containment device 1000 provided according to a first embodiment in a first aspect of the present application. The child containment device 1000 is illustrated with a child playard as an example, but in an alternative embodiment, the child containment device 1000 may be, for example, a baby crib, a playpen, or other forms of child containment device.

The child containment device 1000 as shown in FIG. 1 includes a containment body 100, a first connecting member 200, and a storage basket 300. The containment body 100 is equipped with two child support accessories (which may be referred to as child carrier accessories in the present application) 91 thereon, such as a changing table and a sleeping basket. The two child support accessories 91 are mounted side by side above the containment body 100. In some embodiments, each of the child support accessories 91 may be detachably connected to a handrail of the child containment device 1000 via an adapter 92. It should be understood that one or more child support accessories 91 may be mounted on the child containment device 1000 as needed. In the child containment device 1000 as shown in FIG. 2, the two child support accessories 91 has been removed from the child containment device 1000.

Figure 2:
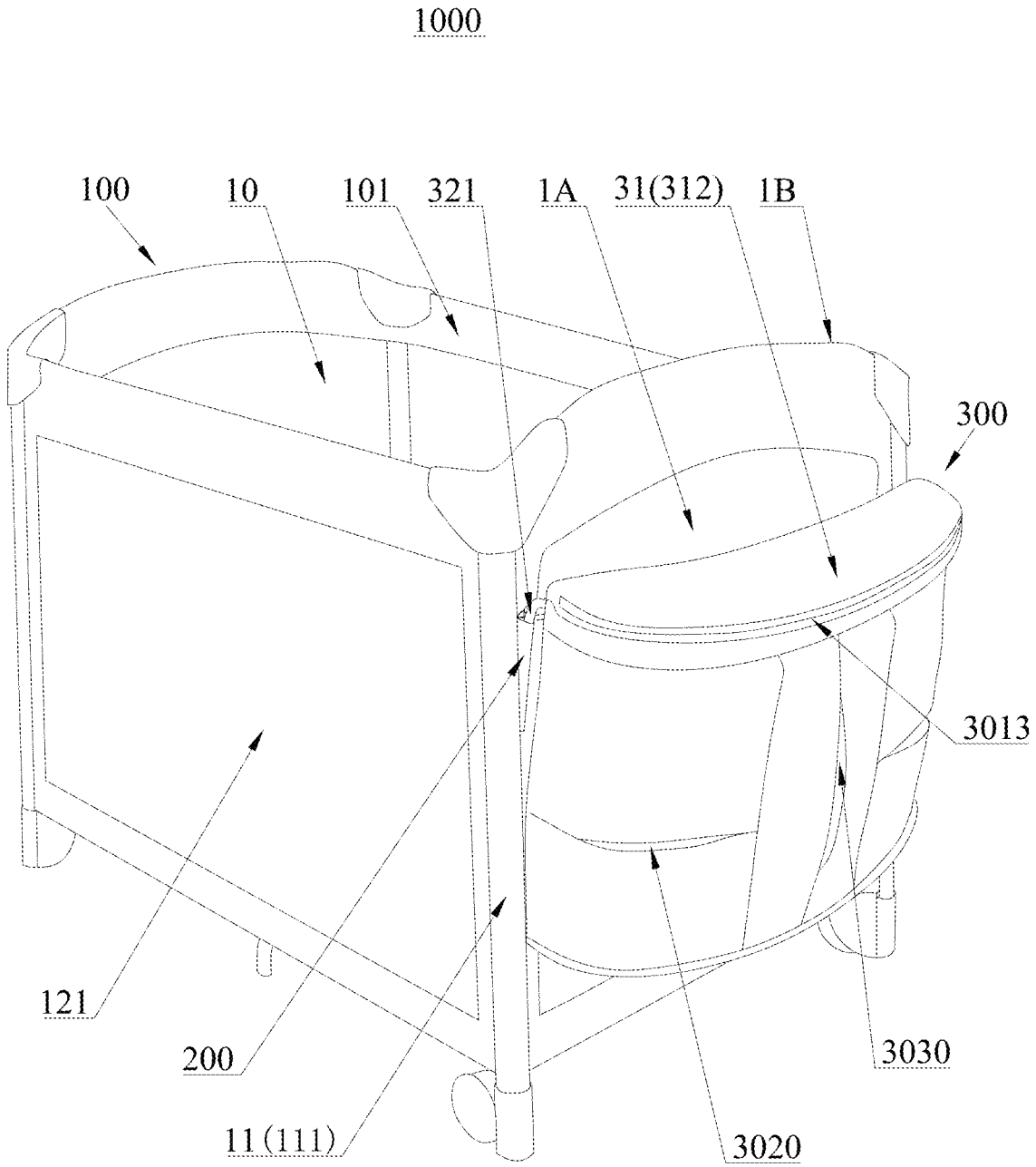
FIG. 2 schematically illustrates a perspective view of the child containment device shown in FIG. 1.
Figure 3:
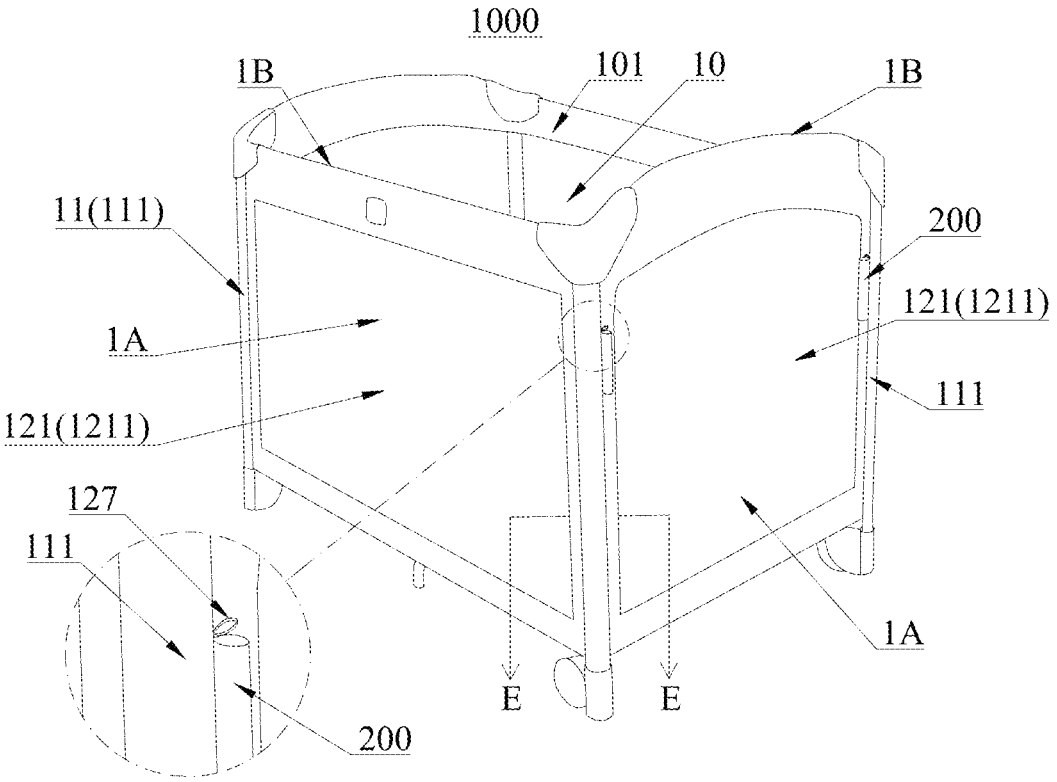
FIG. 3 schematically illustrates a perspective view of a containment body of the child containment device shown FIG. 1.

Referring to FIG. 2 and FIG. 3, in some embodiments, the containment body 100 includes at least one side face 1A enclosing a containment space 10. The at least one side face 1A has a top edge 1B defining a top opening 101 of the containment space 10. The infant or toddler can access the containment space 10 through the top opening 101. The containment space 10 provides safe play and rest space for the infant or toddler.

Figure 4:
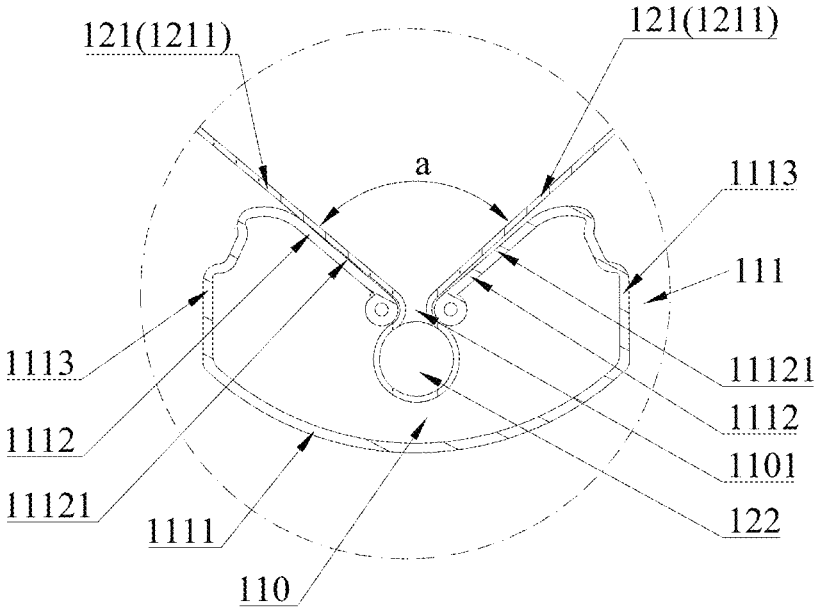
FIG. 4 schematically illustrates a partial sectional view taken along line E-E in FIG. 3.
Figure 5:
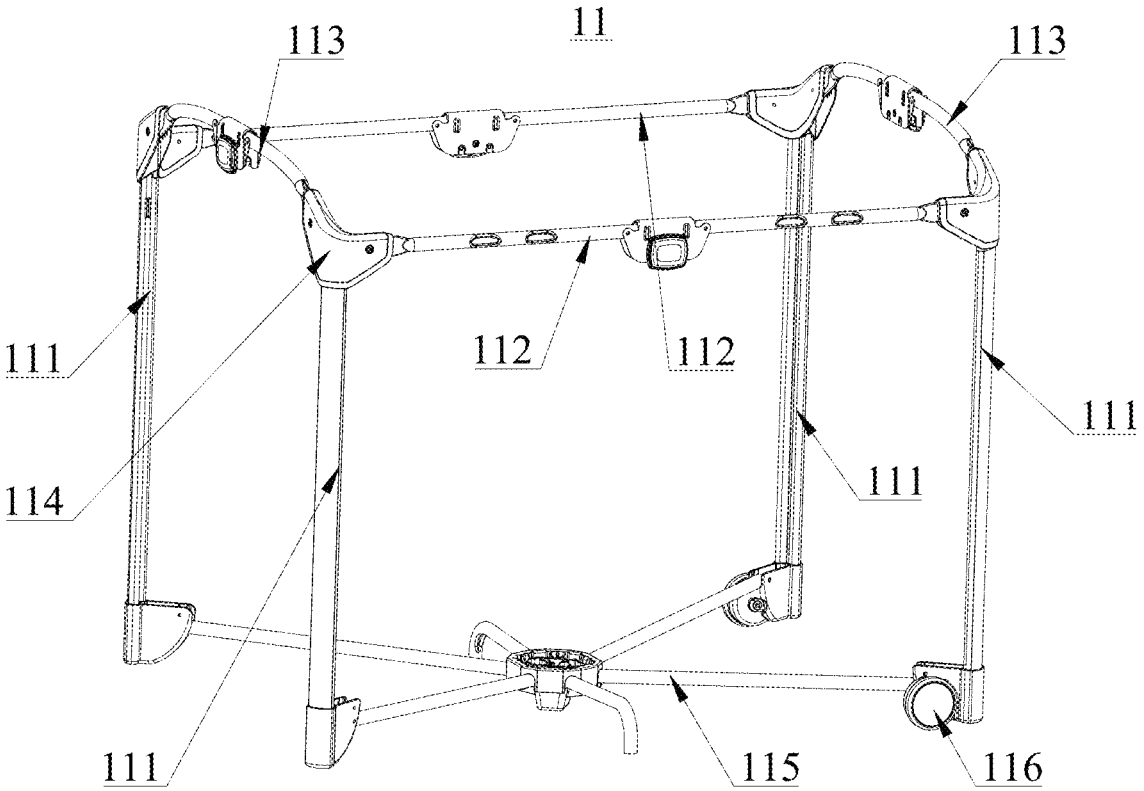
FIG. 5 schematically illustrates a perspective view of a support frame of the containment body shown in FIG. 3.

Referring to FIG. 3 to FIG. 5, an exemplary embodiment of the containment body 100 in the first embodiment is shown. The containment body 100 includes a support frame 11 and an enclosing fabric 121. The support frame 11 includes, for example, four substantially vertical support legs 111 disposed at four corners of a virtual rectangle. Upper ends of the four support legs 111 are connected by a plurality of handrails. More specifically, the upper end of each of the support legs 111 may be provided with a top corner member 114 configured to connect with two adjacent handrails. The plurality of handrails may include two opposite long handrails 112 and two opposite short handrails 113. Lower ends of the four support legs 111 may be connected by a connecting frame 115, and the lower ends of the four support legs 111 may be each mounted with a wheel 116. In some embodiments, the support frame 11 may be foldable for easy storage, and in alternative embodiments, the support frame 11 may be a non-foldable structure.

Referring to FIG. 3, the enclosing fabric 121 is disposed along a periphery of the support frame 11 and is supported by the support frame 11 so as to enclose a containment space 10 that is rectangular in cross-section. The containment space 10 accordingly has four side faces 1A, with two adjacent side faces 1A jointed at one of the four support legs 111 and forming an angle of about 90 degrees therebetween. Each of the handrails is disposed corresponding to the top edge 1B of one of the side faces 1A. In some embodiments, the containment body 100 may also include a bottom face (not shown in the figures) that closes a bottom opening of the enclosing fabric 121 to define a bottom of the containment space 10. In some embodiments, the bottom face may be supported by the connecting frame 115 to reliably support the infant or toddler within the containment space 10.

Referring to FIG. 4, an exemplary embodiment of connecting the enclosing fabric 121 with the support leg 111 is shown. The enclosing fabric 121 includes a plurality of enclosing fabric pieces 1211 corresponding respectively to the plurality of side faces 1A. A joint member 122 is connected between two adjacent enclosing fabric pieces 1211. The joint member 122 may be, for example, a cylindrical rod or a connecting knot formed by two enclosing fabric pieces 1211. Two enclosing fabric pieces 1211 that are connected to the same joint member 122 form an angle a therebetween. The angle a is, for example, about 90 degrees. The angle a is corresponding to the angle formed between two adjacent side faces 1A as described above. The support leg 111 defines an accommodation cavity 110 and includes an outer wall surface 1111 and an inner wall surface 1112 opposite to each other. The outer wall surface 1111 may be exposed without being covered by the enclosing fabric 121. The outer wall surface 111 has, for example, an arched region (i.e., it is arched in cross-section). The inner wall surface 1112 may face the enclosing fabric 121, and the inner wall surface 1112 is, for example, covered by the enclosing fabric 121 and thus is invisible. The outer wall surface 1111 and the inner wall surface 1112 may be connected by two opposite side wall surfaces 1113. The inner wall surface 1112 may be provided with a first engagement opening 1101 at the center thereof. The joint member 122 is positioned in the accommodation cavity 110 and engaged with the first engagement opening 1101 such that the enclosing fabric 121 is connected to the support leg 111.

In some embodiments, the inner wall surface 1112 is trumpet-shaped in cross-section and defines a port proximate to the outer wall surface 1111. This port forms the first engagement opening 1101. The inner wall surface 1112 includes two guiding surfaces 11121 located at two sides of the first engagement opening 1101. The two guiding surfaces 11121 are in one-to-one correspondence to the two enclosing fabric pieces 1211. Each of the guiding surfaces 11121 is used to guide an extension direction of the corresponding enclosing fabric piece 1211.

Figure 6:
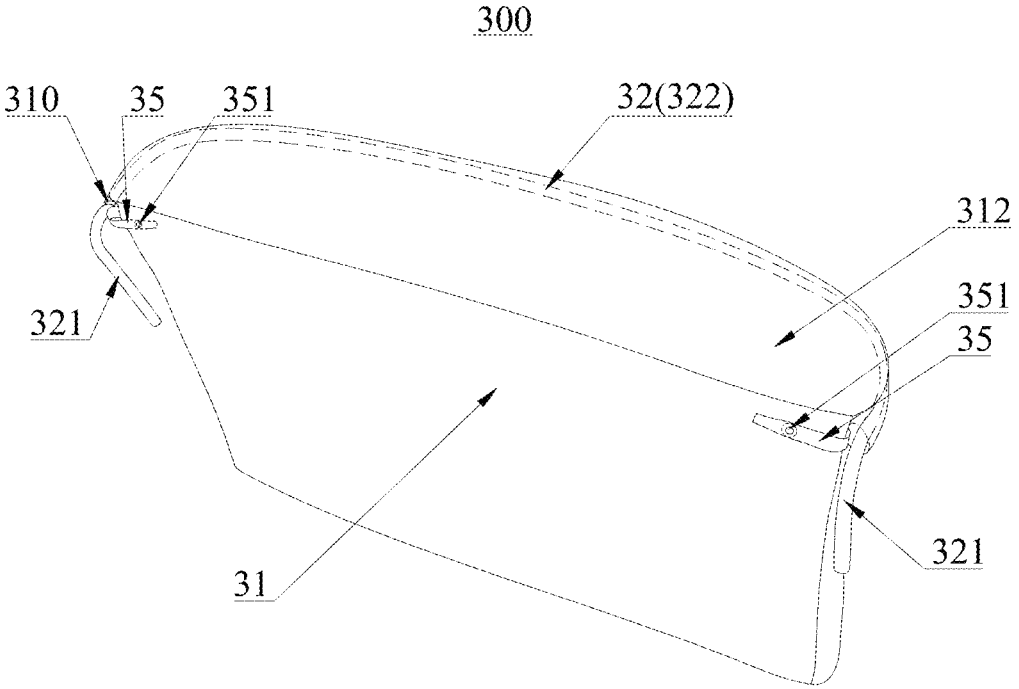
FIG. 6 schematically illustrates a perspective view of a storage basket of the child containment device shown FIG. 1.

Referring again to FIG. 2 and FIG. 3, at least one side face 1A is provided with two first connecting members 200 thereon. The two first connecting members 200 are located at two opposite side edges of the side face 1A. Each of the first connecting members 200 is lower than the top edge 1B of the side face 1A on which it is located. Referring in conjunction to FIG. 6, the storage basket 300 includes a storage body 31 and two second connecting members 321 connected to the storage body 31. The two second connecting members 321 are connected to the two first connecting members 200, respectively, such that the storage body 31 is positioned at an outer side of the side face 1A provided with the first connecting members 200. Since the storage body 31 is positioned at the outer side of the side face 1A when it is connected to the containment body 100, the storage basket 300 does not occupy the space above the containment body 100, thus not affecting the installation of one or more child support accessories 91 in the space above the containment body 100. In addition, since the first connecting members 200 are located lower than the top edge 1B of the corresponding side face 1A, the first connecting members 200 can provide the second connecting members 321 with connecting positions lower than the top edge 1B without occupying the area of the top edge 1B, and do not interfere with the installation of the adapters 92 of the child support accessories 91 on the top edge 1B, thereby providing convenience for the user.

It should be understood that in some embodiments, one or more first connecting members 200 may be provided on the same side face 1A, and the storage basket 300 may accordingly include one or more second connecting members 321. That is, the number of the first connecting members 200 or the second connecting members 321 is not limited to two. In addition, in some embodiments, the first connecting member 200 and the second connecting member 321 are detachably connected to each other such that the storage basket 300 can be removed from the containment body 100 for easy storage of the containment body 100. In addition, in some embodiments, multiple side faces 1A can be each provided with the first connecting members 200, so that the second connecting members 321 of the storage basket 300 can be selectively connected to the first connecting members 200 on any one of the multiple side faces 1A to allow the position of the storage basket 300 to be adjusted as needed.

Referring again to FIG. 1 and FIG. 2, when the storage basket 300 is connected to the containment body 100, the top of the storage basket 300 is lower than the top edge 1B of the side face 1A adjacent thereto. In this way, the storage basket 300 is positioned at the outer side of the corresponding side face and does not extend beyond the top edge 1B of the containment body 100 at all. Consequently, even if some child support accessories 91 need to be placed in the space above the containment body 100 and protrude outwardly from the side face 1A, the storage basket 300 will not obstruct those child support accessories 91 from protrude outwardly from the side face, thereby facilitating the installation of the child support accessories 91.

Figure 8:
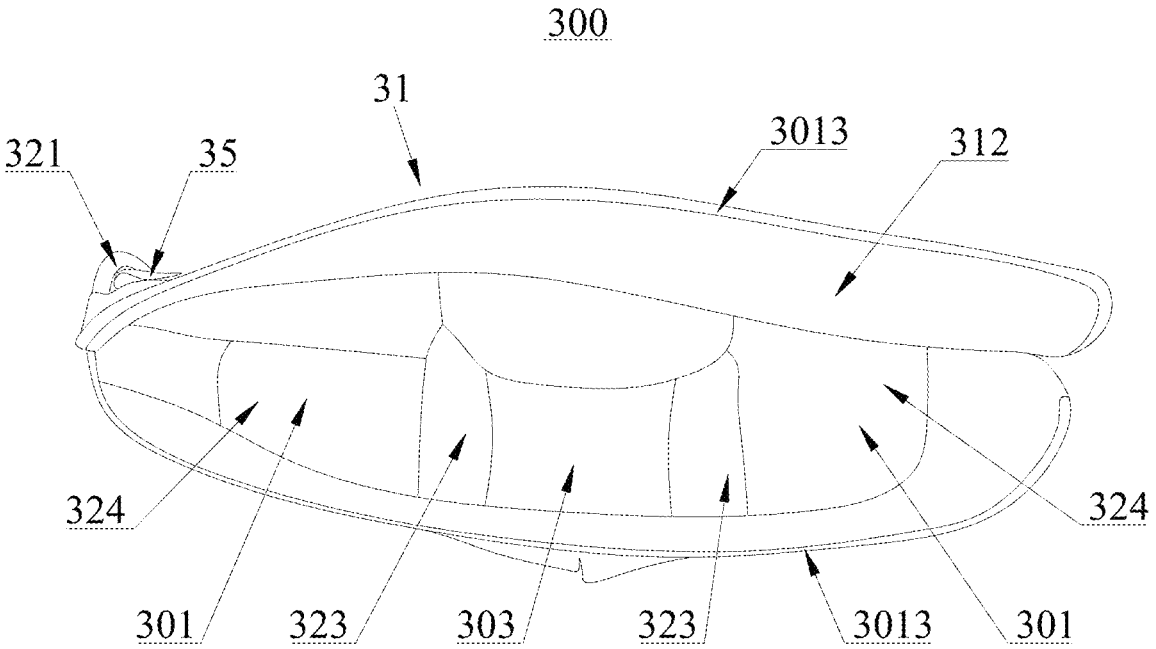
FIG. 8 schematically illustrates another perspective view of the storage basket shown in FIG. 6.

FIG. 1, FIG. 6, and FIG. 8 illustrate an exemplary embodiment of the storage basket 300. In FIG. 1, an internal structure of the storage body 31 is shown in dashed lines. The storage body 31 includes, for example, a first storage space 301 and a second storage space 302 arranged up and down. The first storage space 301 and the second storage space 302 are partitioned by a first partition 324 extending substantially horizontally. The storage body 31 has a first opening 3010 on a top thereof and a second opening 3020 on a side thereof. The first opening 3010 is in communication with the first storage space 301. The second opening 3020 is in communication with the second storage space 302. The second opening 3020 is located lower than the first opening 3010.

In some embodiments, the storage body 31 may also include a third storage space 303. The third storage space 303 is partitioned from both the first storage space 301 and the second storage space 302 by a second partition 323 extending substantially vertically, such that both the first storage space 301 and the second storage space 302 are located at the same side of the second partition 323, and the third storage space 303 is located at the other side of the second partition 323. In some embodiments, the third storage space 303 has a depth approximately equal to the sum of the depths of the first storage space 301 and the second storage space 302. In some embodiments, the first opening 3010 may be in communication with the third storage space 303. In some embodiments, the storage body 31 has a third opening 3030 on the side thereof. The third opening 3030 is lower than the first opening 3010 and is in communication with the third storage space 303.

In some embodiments, the third storage space 303 is located at the center of the storage body 31, and the first storage space 301 and the second storage space 302 in an up-and-down arrangement may be provided at each of the left and right sides of the third storage space 303. In some embodiments, the side of the second storage space 302 is in a transparent state or a net structure so that the user can observe the items placed in the second storage space 302.

In addition, the storage body 31 may also include a top cover 312, which can open or close the first opening 3010. In some embodiments, the top cover 312 may be a flip cover and the first opening 3010 may be closed by a zipper 3013 (see FIG. 2) or other closing member. In addition, the second opening 3020 and the third opening 3030 can also be provided with the closing members accordingly.

Referring to FIG. 6, the storage basket 300 may include a support rod 32. The storage body 31 may include a connecting channel 310. A middle part 322 of the support rod 32 extends through the connecting channel 310, and two ends of the support rod 32 extends outside of the connecting channel 310 to form two second connecting member 321. The support rod 32 may be removed from the connecting channel 310 to facilitate cleaning of the storage body 31.

Figure 7:
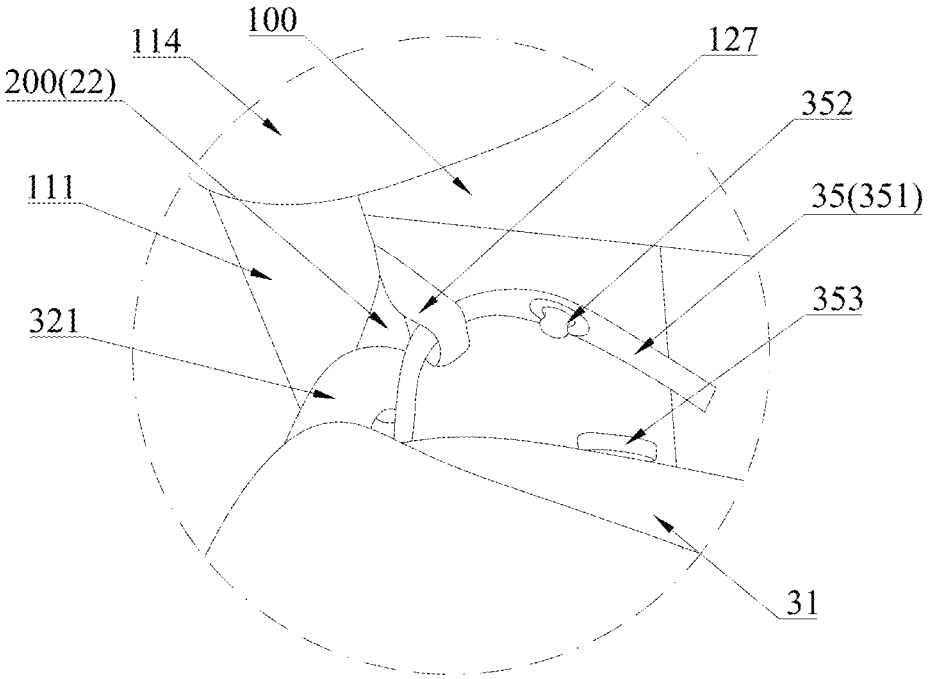
FIG. 7 schematically illustrates a partially enlarged view at the connecting position of the containment body and the storage basket of the child containment device shown FIG. 1.

Referring to FIG. 3, FIG. 6, and FIG. 7, in some embodiments, the first connecting member 200 includes a fabric sleeve connected to the enclosing fabric 121. The fabric sleeve forms a second housing part 22 for housing the second connecting member 321. The fabric sleeve extends in a height direction of the containment body 100. Each of the second connecting members 321 may be inserted into a hollow channel of the corresponding fabric sleeve such that the storage basket 300 is connected to the containment body 100.

Referring again to FIG. 7, in some embodiments, the containment body 100 may include a first limiting part 127. The storage body 31 may include a second limiting part 35. The first limiting part 127 is detachably connected to the second limiting part 35. The connection of the first limiting part 127 to the second limiting part 35 not only assists in connecting the containment body 100 to the storage body 31, but also prevents the storage body 31 from moving away from the side face 1A of the containment body 100. In some embodiments, the first limiting part 127 includes, for example, a first connecting ring connected to the enclosing fabric 121, and the second limiting part 35 includes a second connecting ring connected to the storage body 31. The second connecting ring can be opened and an end 351 of the opened second connecting ring can pass through the first connecting ring to connect the second connecting ring to the first connecting ring. In some embodiments, the end 351 of the second connecting ring can be connected to the storage body 31 using complementary snap buttons 352 and 353 or other suitable fasteners. The second connecting ring is closed once the end 351 of the second connecting ring is connected to the storage body 31. In some alternative embodiments, the first connecting ring can be opened to connect to the second connecting ring.

Figure 9:
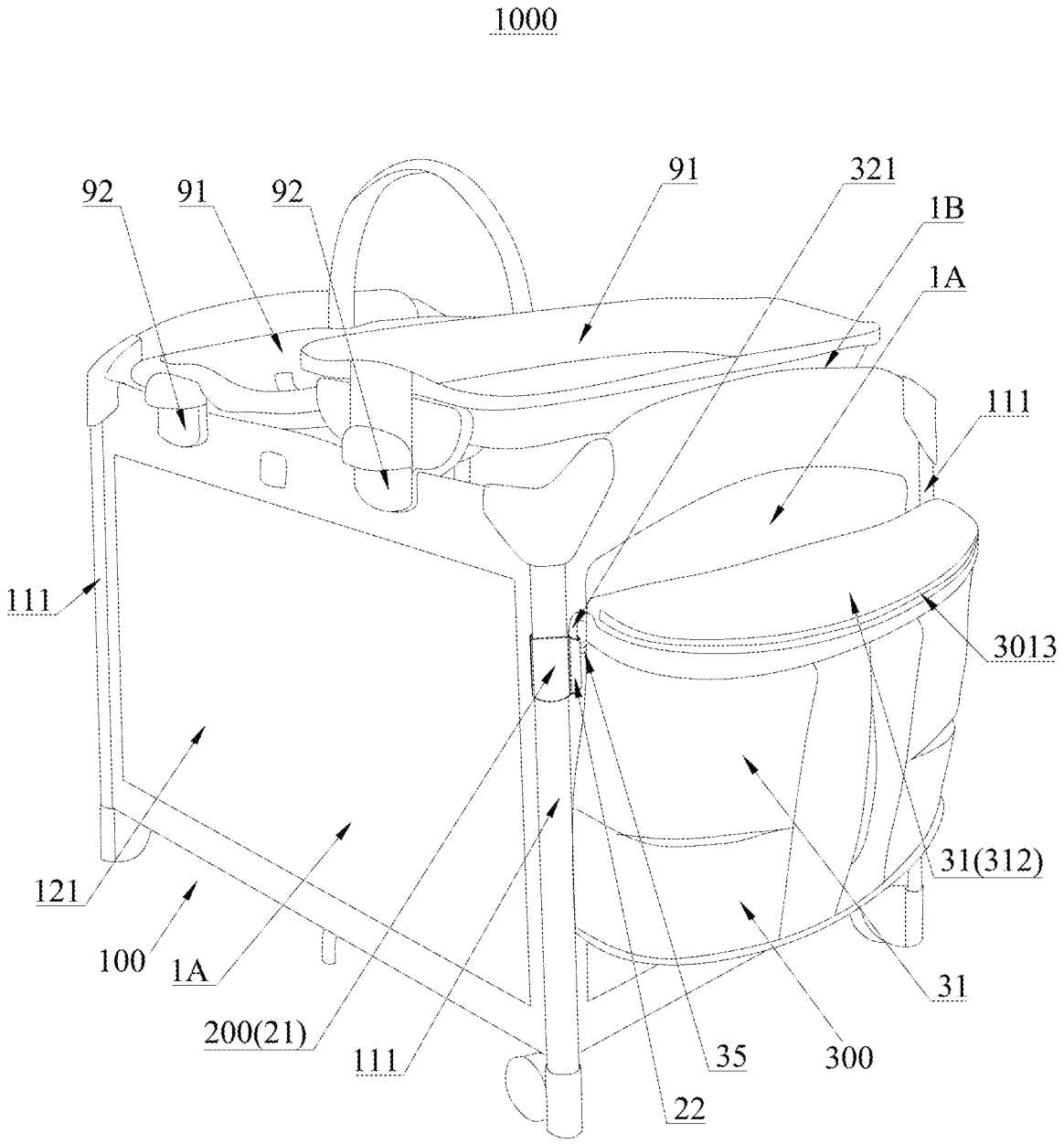
FIG. 9 schematically illustrates a perspective view of a child containment device equipped with two child support accessories according to a second embodiment in the first aspect of the present application.

FIG. 9 illustrates a perspective view of a child containment device 1000 provided according to a second embodiment in the first aspect of the present application. The main difference between the child containment device 1000 in the second embodiment and the child containment device 1000 in the first embodiment is the implementation manner of the first connecting member 200. The structures of the components in the second embodiment and the connection relationships between the components can be referenced to those described in the first embodiment as long as there is no contradiction.

Figure 10:
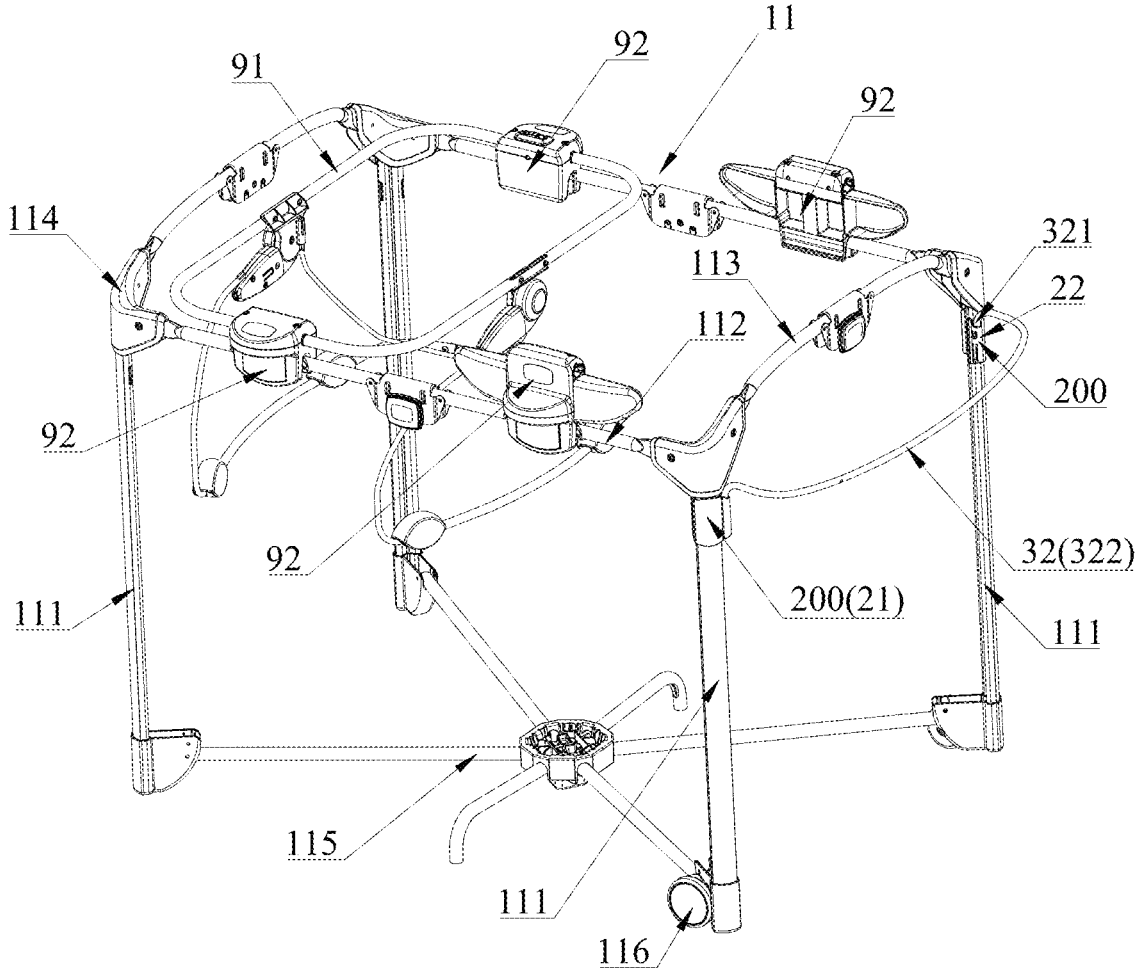
FIG. 10 schematically illustrates a perspective view of a support frame of a containment body of the child containment device and a frame structure of the child support accessory shown in FIG. 9.
Figure 11:
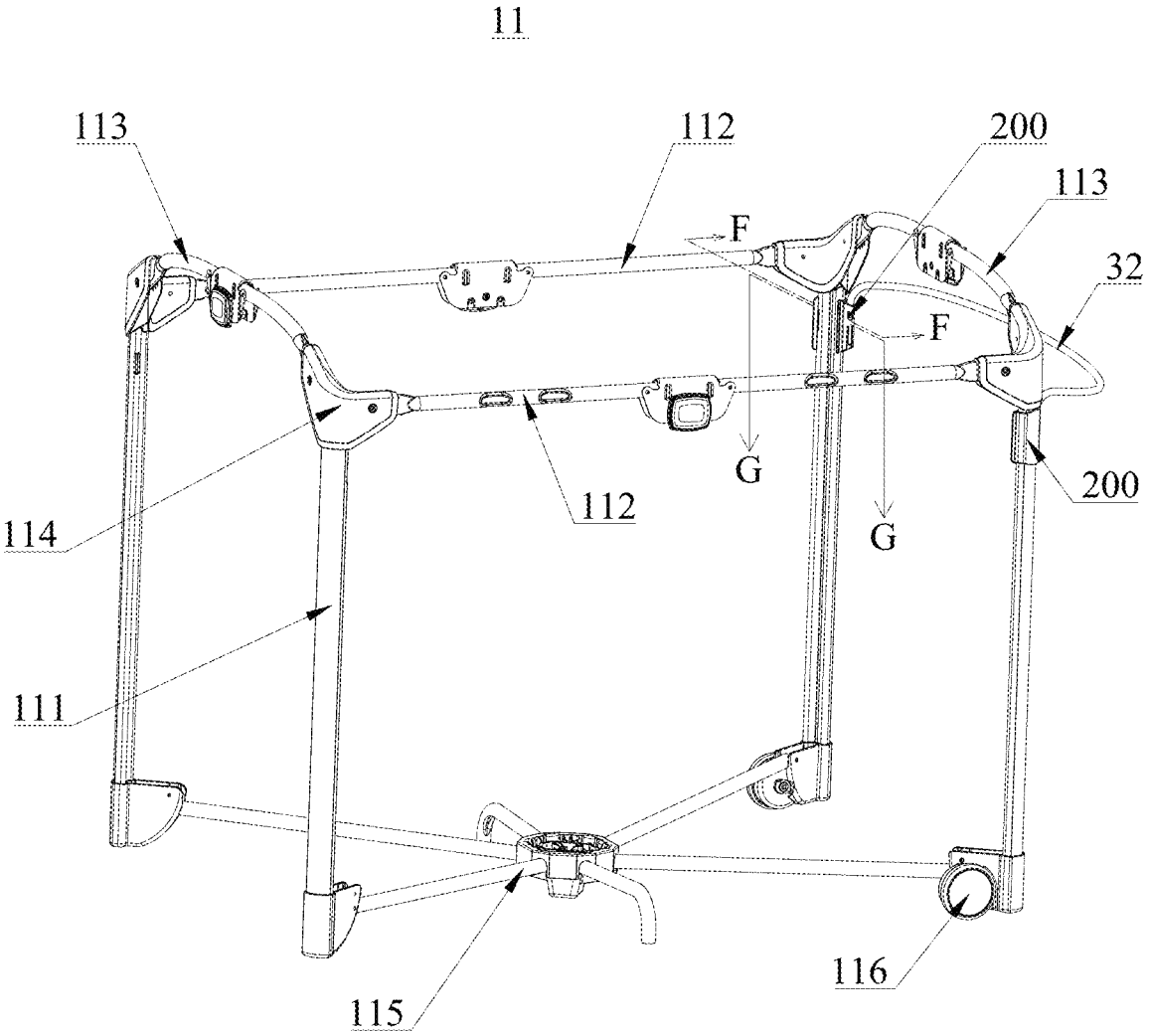
FIG. 11 schematically illustrates another perspective view of the support frame of the containment body of the child containment device shown in FIG. 9.

Referring to FIG. 9 to FIG. 11, the containment body 100 may include a support frame 11 and an enclosing fabric 121. The support frame 11 includes a plurality of support legs 111. Each of the first connecting members 200 can be connected to the corresponding support leg 111. The support leg 111 that is connected to the first connecting member 200 may also be referred to as a connecting post. The connection between the enclosing fabric 121 and the support frame 11 may be referenced to that described in the first embodiment.

Figure 12:
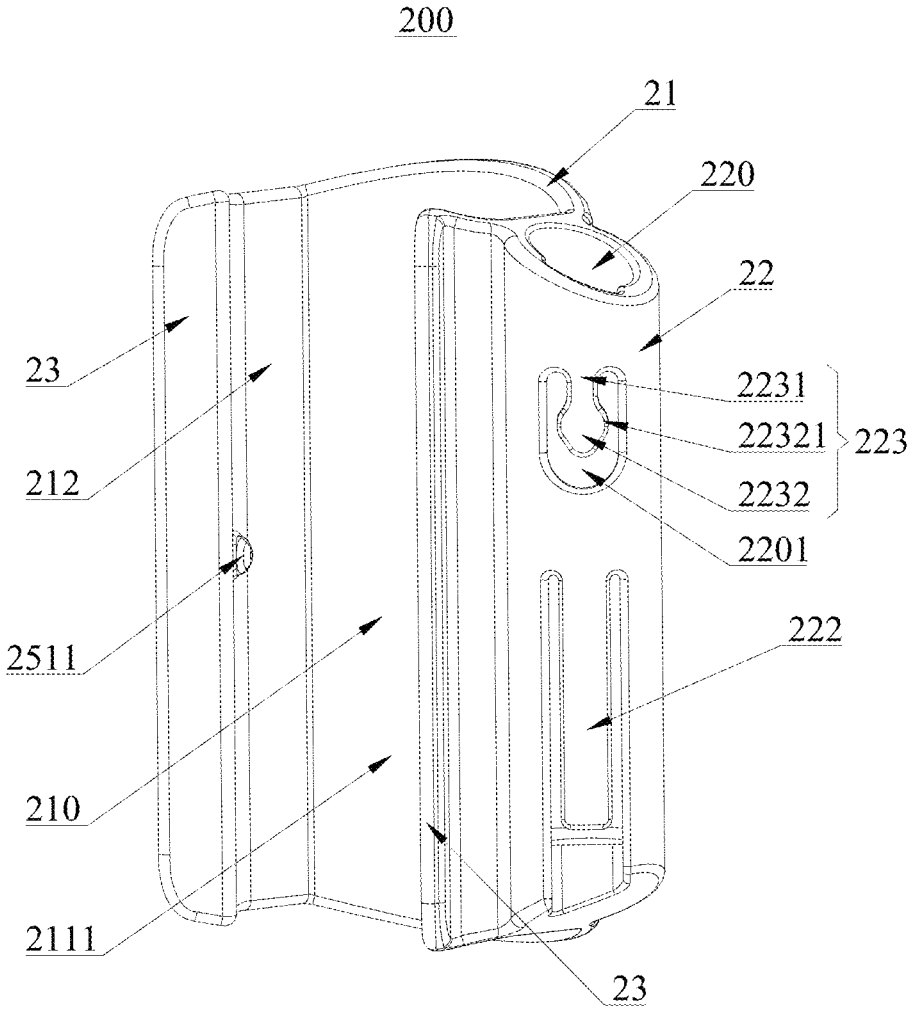
FIG. 12 schematically illustrates a perspective view of an embodiment of a first connecting member shown in FIG. 10.

Referring to FIG. 10 and FIG. 12, the first connecting member 200 may include a first housing part 21 and a second housing part 22. The first housing part 21 is used to house the corresponding support leg 111 such that the first connecting member 200 is connected to the corresponding support leg 111. The second housing part 22 is used to house the corresponding second connecting member 321, such that the storage basket 300 is connected to the first connecting member 200 and thus to the containment body 100.

Figure 13:
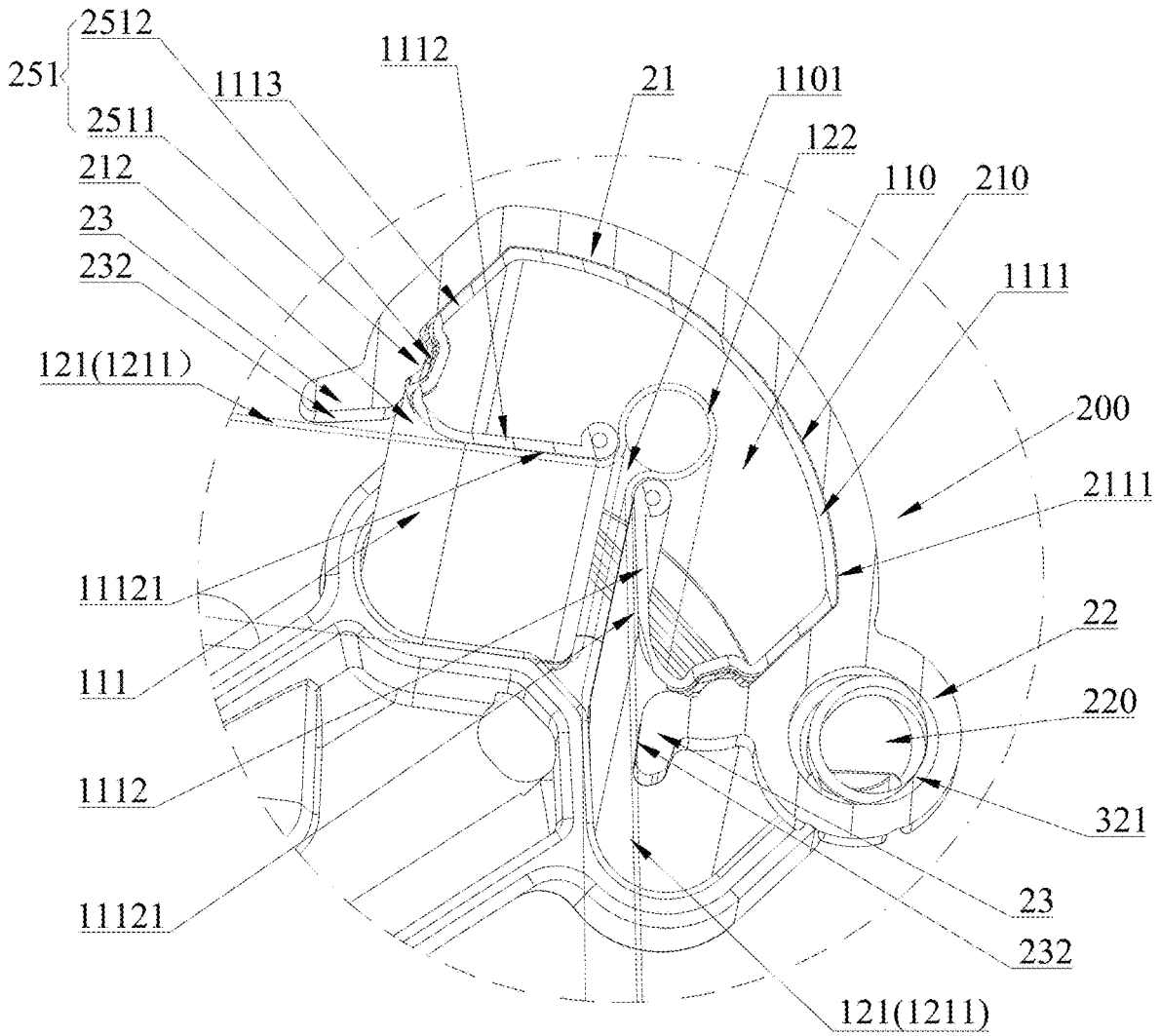
FIG. 13 schematically illustrates a partial sectional perspective view taken along line G-G in FIG. 11.

Referring to FIG. 12, the first connecting member 200 may be a C-shaped engagement member in one piece. The first housing part 21 has a second engagement opening 212. The first housing part 21 is detachably engaged with the support leg 111 through the second engagement opening 212. This allows for adjusting the position of the storage basket 300 by connecting the first connecting member 200 to different support legs 111, enabling the storage body 31 of the storage basket 300 to be positioned on the outer side of any of the various side faces 1A without the necessity of installing the first connecting member 200 on each of the support legs 111. Referring to FIG. 13, in some embodiments, a shape of an inner cavity 210 of the first housing part 21 matches with a shape of the support leg 111 to provide a sufficiently large contact area. Specifically, an inner wall surface 2111 of the first housing part 21 (the wall surface of the inner cavity 210) includes an arched region that fits against the outer wall surface 1111 of the support leg 111 and a region that fits against the side wall surface 1113 of the support leg 111.

Referring again to FIG. 13, in some embodiments, the first connecting member 200 includes at least one extending part 23 that extends outward from at least one side of the second engagement opening 212. In some embodiments, the extending part 23 has, for example, a surface 232 facing the enclosing fabric. The surface 232 is used to withstand the force applied by the user to open the second engagement opening 212 to remove the first connecting member 200 from the support leg 111. In this embodiment, the first connecting member 200 includes two extending parts 23 that extend outward from both sides of the second engagement opening 212, allowing users to apply force to both extending parts 23 to expand the second engagement opening 212 and easily remove the first connecting member 200 from the support leg 111.

Referring again to FIG. 12 and FIG. 13, a first positioning structure 251 is provided between the first housing part 21 and the support leg 111. The first positioning structure 251 is configured to secure the relative position of the first housing part 21 to the support leg 111, preventing any unintended sliding of the first connecting member 200 along the support leg 111. In some embodiments, the first positioning structure 251 includes at least one first positioning protrusion 2511 and at least one first positioning recess 2512 that are detachably engaged with each other. The first positioning protrusion 2511 is provided on one of the first housing part 21 and the support leg 111, while the first positioning recess 2512 is provided on the other one of the first housing part 21 and the support leg 111. In this embodiment, the first positioning protrusion 2511 is provided on, for example, an inner wall of the first housing part 21, while the first positioning recess 2512 is provided on, for example, the side wall surface 1113 of the support leg 111. It should be understood that the implementation manner of the first positioning structure 251 is not limited to the above embodiments.

In some unshown embodiments, the first housing part 21 can slide along the support leg 111 to allow for adjusting the relative position of the first housing part 21 to the support leg 111. In some embodiments, when at least one of the support legs 111 serves as the connecting post, the structures of the first positioning protrusion 2511 and the first positioning recess 2512 are reasonably designed to allow the first connecting member 200 to be pushed upward along the corresponding support leg 111 but resists the downward movement of the first connecting member 200 along the corresponding support leg 111. This prevents unexpected downward sliding of the first connecting member 200 along the support leg 111 when the storage basket 300 is heavily loaded. In some embodiments, the first positioning structure 251 may include multiple first positioning protrusions 2511 and/or multiple first positioning recesses 2512. The first positioning protrusions 2511 can selectively engage with the first positioning recesses 2512 to position the first housing part 21 at different heights on the support leg 111. It should be understood that by having the first connecting member 200 slidably connected to the vertically extending connecting post (specifically, the support leg 111), the height position of the storage basket 300 on the corresponding side face 1A can be adjusted to be adapted to the storage baskets 300 of different depths or to users of different heights, facilitating item retrieval and placement.

Figure 14:
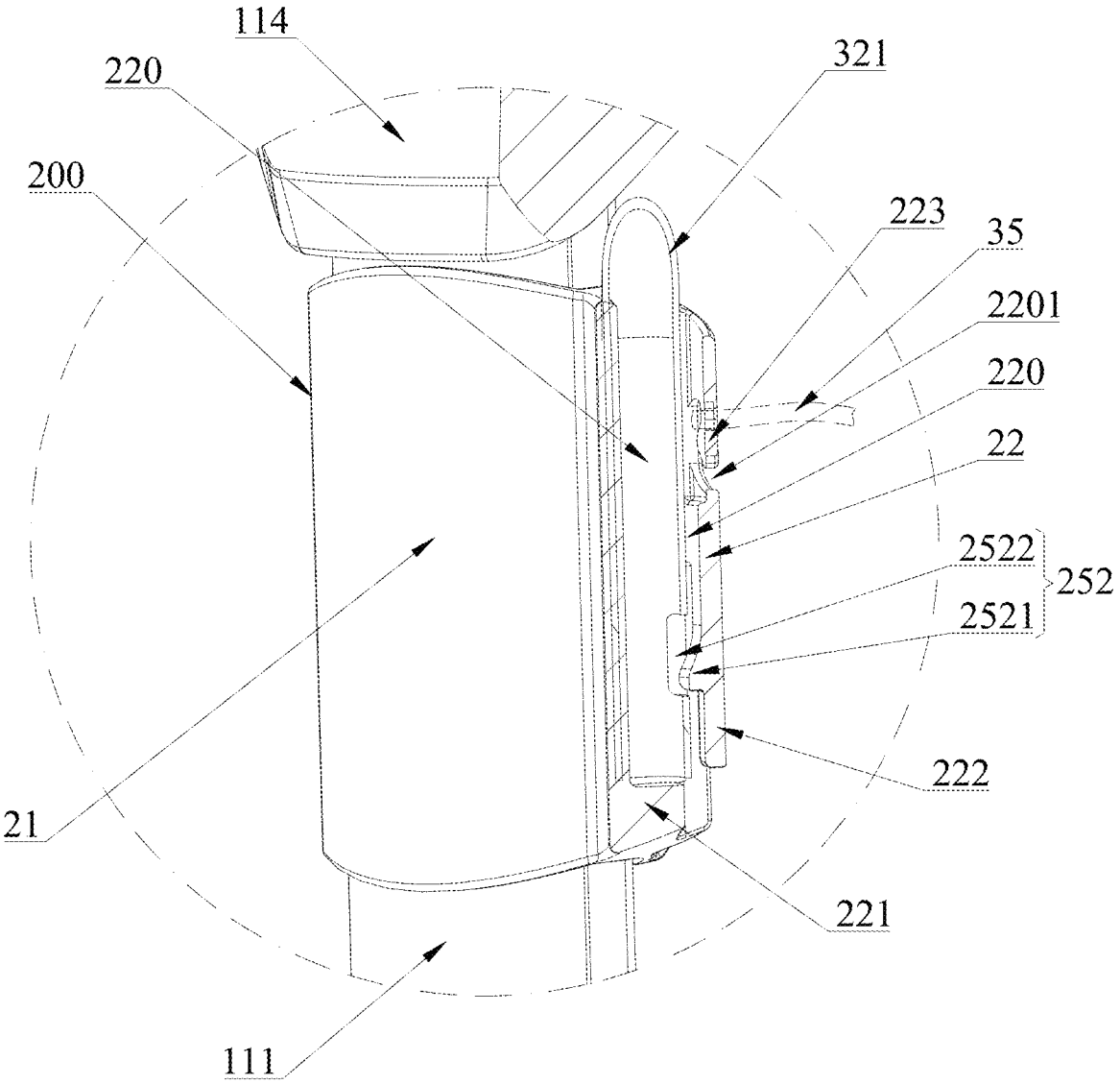
FIG. 14 schematically illustrates a partial sectional view taken along line F-F in FIG. 11.

Referring again to FIG. 12 and FIG. 13, the second housing part 22 may include an insertion slot 220 extending in the height direction. The second connecting members 321 at ends of the support rod 32 of the storage basket 300 can be detachably inserted into the corresponding insertion slots 220. Referring to FIG. 14, in some embodiments, the second housing part 22 is provided with a stopping portion 221 to limit the insertion depth of the second connecting member 321.

Referring to FIG. 12 and FIG. 14, the wall of the second housing part 22 can be provided with an elastic arm 222. A second positioning structure 252 can be provided between the elastic arm 222 and the second connecting member 321 to prevent the second connecting member 321 from disengaging from the second housing part 22. In some embodiments, the second positioning structure 252 may include at least one second positioning protrusion 2521 and at least one second positioning recess 2522 that are detachably engaged with each other. The second positioning protrusion 2521 is provided on one of the elastic arm 222 and the second connecting member 321, while the second positioning recess 2522 is provided on the other one of the elastic arm 222 and the second connecting member 321. In this embodiment, the second positioning protrusion 2521 is provided on the elastic arm 222, and the second positioning recess 2522 is provided on the second connecting member 321. To remove the second connecting member 321 from the second housing part 22, the elastic arm 222 can be pulled to disengage the second positioning protrusion 2521 from the second positioning recess 2522. As shown in FIG. 12 and FIG. 14, there is clearance space between the bottom of the second housing part 22 and the free end of the elastic arm 222, allowing users to pull the free end of the elastic arm 222 to disengage the second positioning protrusion 2521 from the second positioning recess 2522. It should be understood that the implementation manner of the second positioning structure 252 is not limited to the embodiments above.

Continuing with reference to FIG. 12 and FIG. 14, the first connecting member 200 may include a first limiting part 223. The storage body 31 includes a second limiting part 35 (as shown in FIG. 14, the second limiting part 35 is indicated by dashed lines). The first limiting part 223 is detachably connected to the second limiting part 35. The connection of the first limiting part 223 to the second limiting part 35 not only assists in connecting the containment body 100 to the storage body 31, but also prevents the storage body 31 from moving away from the side face 1A of the containment body 100. In some embodiments, the first limiting part 223 includes, for example, a connecting strip provided on the wall of the second housing part 22 of the first connecting member 200. The second limiting part 35 includes a connecting ring or a connecting strap attached to the storage body 31. The connecting ring or the connecting strap wraps around the connecting strip. When the connecting ring is adopted for the second limiting part 35, the connecting ring in the second embodiment can be referenced to the second connecting ring described in the first embodiment, which will not be described repeatedly herein. In some embodiments, the first limiting part 223 may protrude outward from the wall of the second housing part 22 instead of being provided on the wall of the second housing part 22, or the first limiting part 223 may adopt the first connecting ring described in the first embodiment. The first limiting part 223 can have other structures as long as it can be connected to the second limiting part 35 and prevent the storage body 31 from moving away from the side face 1A of the containment body 100.

Referring again to FIG. 12, in some embodiments, the connecting strip that serves as the first limiting part 223 has a fixed end 2231 jointed with the second housing part 22 and a free end 2232 to connect with the second limiting part 35. There is a gap 2201 between the connecting strip and the wall of the second housing part 22 (which gap 2201 is, for example, in communication with the insertion slot 220). The second limiting part 35 can be slid from the free end 2232 into the gap 2201 to be connected to the first limiting part 223. The free end 2232 has a projection 22321 which is configured to prevent easy disconnection of the second limiting part 35 from the connecting strip.

Figure 15:
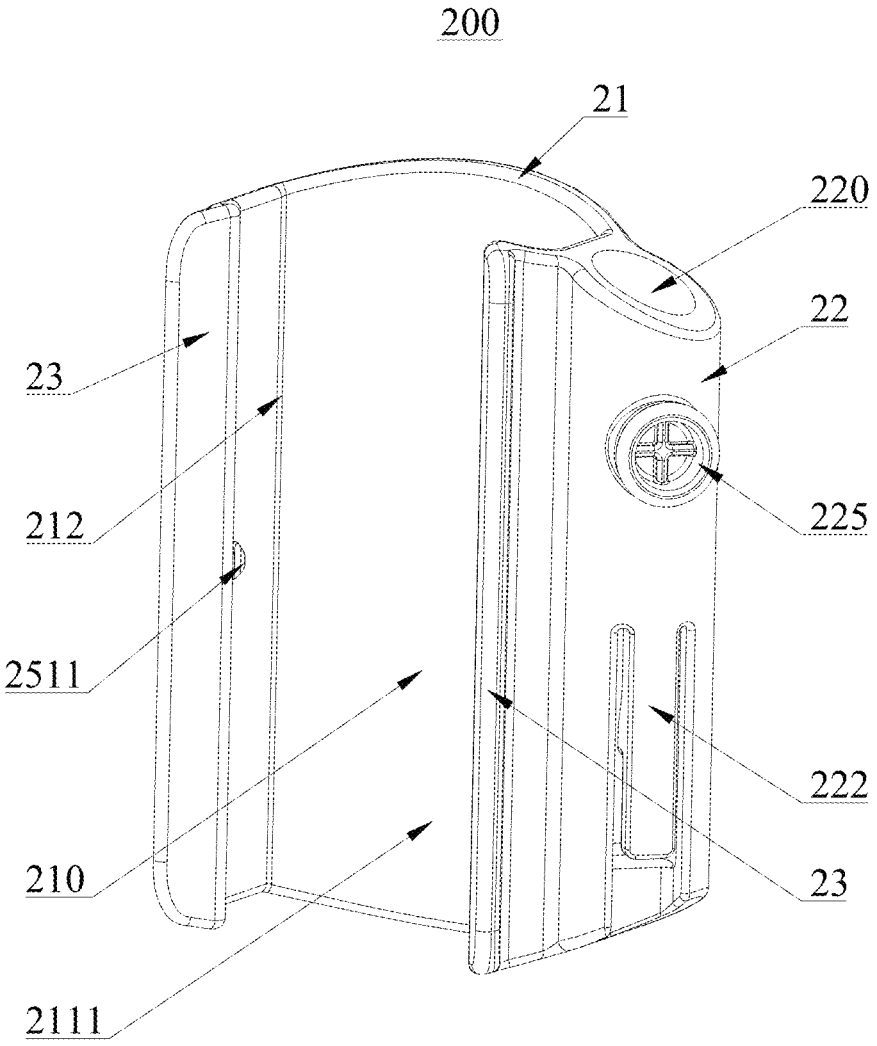
FIG. 15 schematically illustrates a perspective view of another embodiment of the first connecting member shown in FIG. 10.

FIG. 15 illustrates another embodiment of the first limiting part 223. The first limiting part 223 includes, for example, a first button 225 provided on the first connecting member 200. The second limiting part 35 may be, for example, a second button (not shown) attached to the storage body 31. The first button 225 is detachably connected to the second button. The first button 225 and the second button may be snap buttons that cooperate with each other or may be other fasteners that cooperate with each other. In some embodiments, the first button 225 is provided, for example, on the wall of the second housing part 22 and is integrated with the first connecting member 200. The second button may be provided at any suitable position on the storage body 31.

Figure 16:
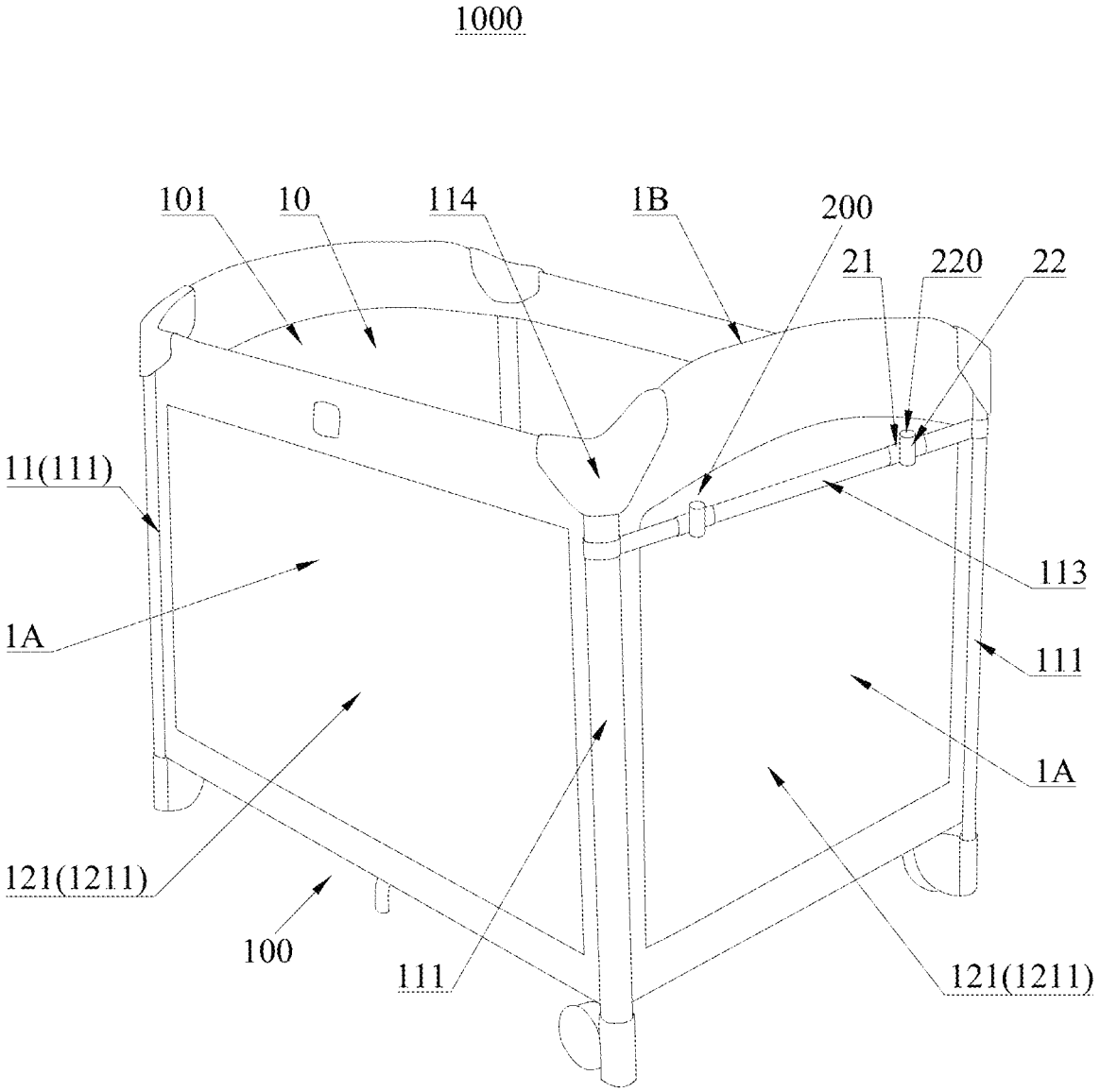
FIG. 16 schematically illustrates a perspective view of a containment body of a child containment device according to a third embodiment in the first aspect of the present application.

FIG. 16 illustrates a perspective view of a child containment device 1000 provided according to a third embodiment in the first aspect of the present application, which is a variant of the child containment device 1000 in the second embodiment in the first aspect as described above. The main difference between the child containment device 1000 in this embodiment and the child containment device 1000 in the second embodiment is in the implementation manners of the connecting post 113 and the first connecting member 200. As long as there is no contradiction, the structures of the components and the connection relationships between the components can be referenced to those described in the second embodiment.

In this embodiment, the containment body 100 may include a support frame 11 and an enclosing fabric 121. The support frame 11 includes a plurality of support legs 111 and a connecting post 113 transversely connected between two adjacent support legs 111. The connecting post 113 may be removably engaged with the first housing parts 21 of multiple first connecting members 200. The first housing part 21 may be in a C-shaped structure. The second housing part 22 of the first connecting member 200 has, for example, an insertion slot 220. Each of the second connecting members 321 of the storage basket 300 may be detachably inserted into the corresponding insertion slot 220. Each of the first connecting member 200 may be in form of one-piece.

In some unshown embodiments, when the connecting post 113 is transversely connected between two adjacent support legs 111, the first housing part 21 may be provided to be capable of sliding transversely along the connecting post 113 to allow for adjusting the relative position of the first housing part 21 to the connecting post 113 to be adapted to storage baskets 300 of different widths or to facilitate the sliding of the storage basket 300 to a certain position for a user to pick up and place an item. It should be noted that in this case, the first connecting member 200 can be positioned at a certain position of the connecting post 113 by a corresponding first positioning structure 251 similar to that described in the second embodiment. Of course, since the connecting post 113 already limits the height position of the first connecting member 200, the first positioning structure may be canceled when there is no need to limit the transverse position of the first connecting member 200 on the connecting post 113. Furthermore, in some embodiments, the first limiting part 223 as described in the second embodiment may be provided on the first connecting member 200 to connect with the second limiting part 35 of the storage basket 300.

Figure 17:
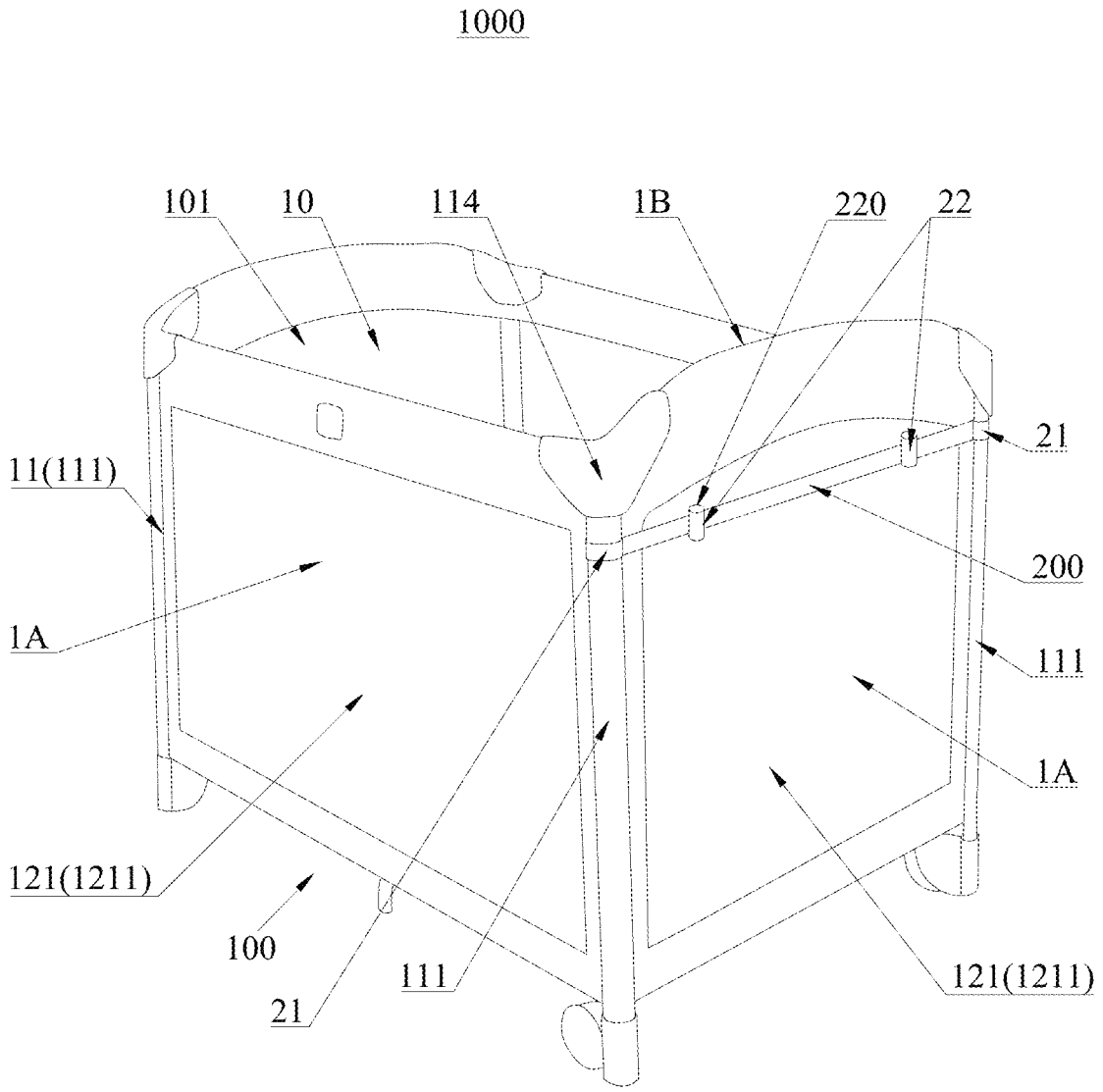
FIG. 17 schematically illustrates a perspective view of a containment body of a child containment device according to a fourth embodiment in the first aspect of the present application.

FIG. 17 illustrates a perspective view of a child containment device 1000 provided according to a fourth embodiment in the first aspect of the present application, which is a variant of the child containment device 1000 of the first embodiment in the first aspect as described above. The main difference between the child containment device 1000 in this embodiment and the child containment device 1000 provided in the first embodiment is in the implementation manner of the first connecting member 200. As long as there is no contradiction, the structures of the components and the connection relationships between the components in this embodiment can be referenced to those described in the first embodiment.

Referring to FIG. 17, the containment body 100 may include a support frame 11 and an enclosing fabric 121. The support frame 11 includes a plurality of support legs 111. The first connecting member 200 includes a transverse rod connected between two adjacent support legs 111. The transverse rod is provided with a plurality of second housing parts 22. The second housing part 22 has, for example, an insertion slot 220. Each of the second connecting members 321 of the storage basket 300 may be detachably inserted into the corresponding insertion slot 220.

In FIG. 17, the two support legs 111 to which the first connecting member 200 is connected may be referred to as connecting posts, and two ends of the first connecting member 200 are each provided with a first housing part 21 to house the corresponding support leg 111. In some embodiments, the first housing part 21 is, for example, detachably connected to the corresponding support leg 111, and a height of the first housing part 21 relative to the corresponding support leg 111 is, for example, adjustable. In some embodiments, the first housing part 21 is, for example, secured to a fixed position of the corresponding support leg 111 by a fastener. In some embodiments, the first connecting member 200 may be provided with no first housing part 21 and is connected to the corresponding support leg 111 by, for example, a plug-in structure.

It should be noted that although the insertion slot 220 of the first connecting member 200 extends in the height direction and the second connecting member 321 corresponding thereto also extends in the height direction in the above embodiments, the insertion slot 220 may be varied to extend transversely and the second connecting member 321 corresponding thereto may also extend transversely so as to be capable of inserting to the insertion slot 220 in other embodiments.

Figure 18:
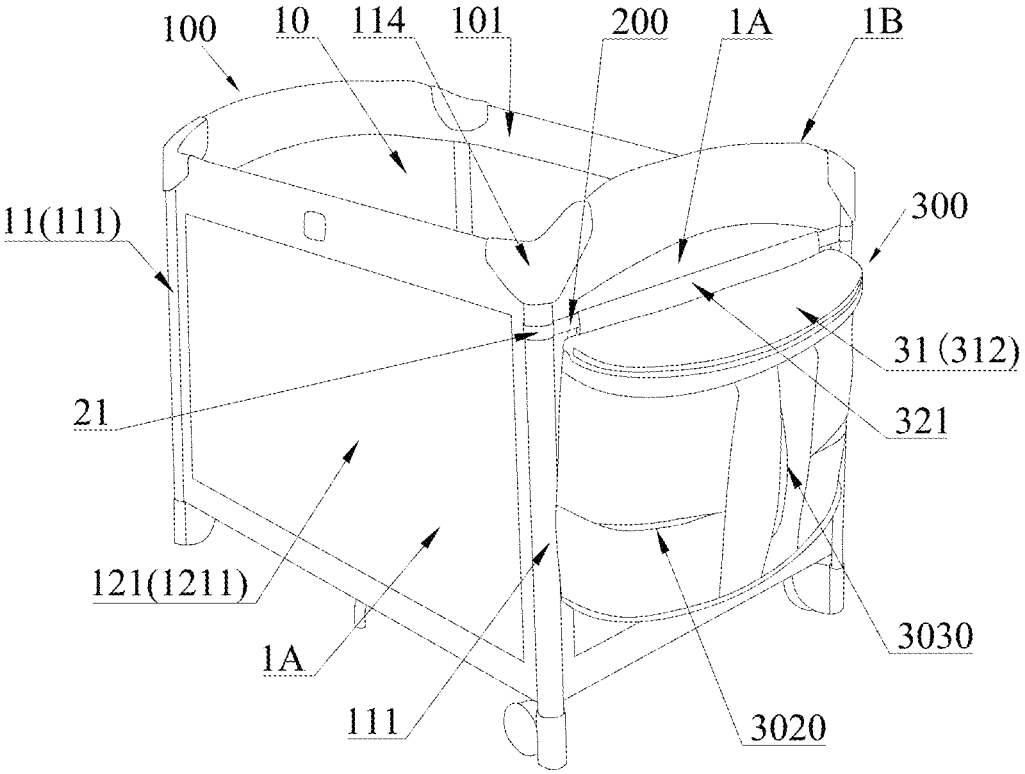
FIG. 18 schematically illustrates a perspective view of a child containment device according to a fifth embodiment in the first aspect of the present application.

FIG. 18 illustrates a perspective view of a child containment device 1000 provided according to a fifth embodiment in the first aspect of the present application, which is a variant of the child containment device 1000 in the fourth embodiment in the first aspect as described above. The main difference between the child containment device 1000 in this embodiment and the child containment device 1000 provided in the fourth embodiment as described above is in the implementation manners of the first connecting member 200 and the storage basket 300. As long as there is no contradiction, the structures of the components and the connection relationships between the components in this embodiment can be referenced to those described in the fourth embodiment.

Referring to FIG. 18, the containment body 100 may include a support frame 11 and an enclosing fabric 121. The support frame 11 includes a plurality of support legs 111. The first connecting member 200 includes a transverse rod connected between two adjacent support legs 111. The transverse rod is provided with no second housing part 22. The two support legs 111 to which the first connecting member 200 is connected may be referred to as connecting posts.

Figure 19:
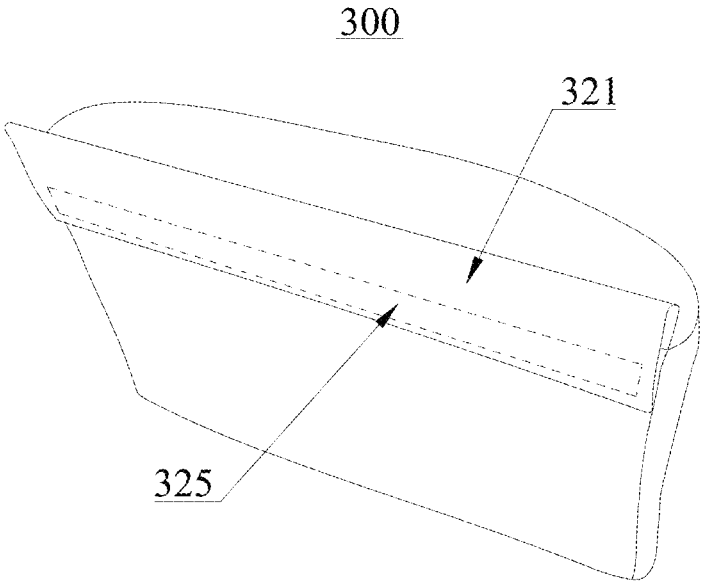
FIG. 19 schematically illustrates a perspective view of a storage basket of the child containment device shown in FIG. 18.

Referring to FIG. 19, the second connecting member 321 of the storage basket 300 may include a connecting sleeve that is connected to the storage body 31. The connecting sleeve may be opened or closed. The connecting sleeve may be closed, for example, with a Velcro 325 or other closure member. The connecting sleeve is wrapped around the first connecting member 200 when it is opened and then closed by the closure member so as to be connected to the first connecting member 200 to connect the storage basket 300 to the containment body 100.

Figure 20:
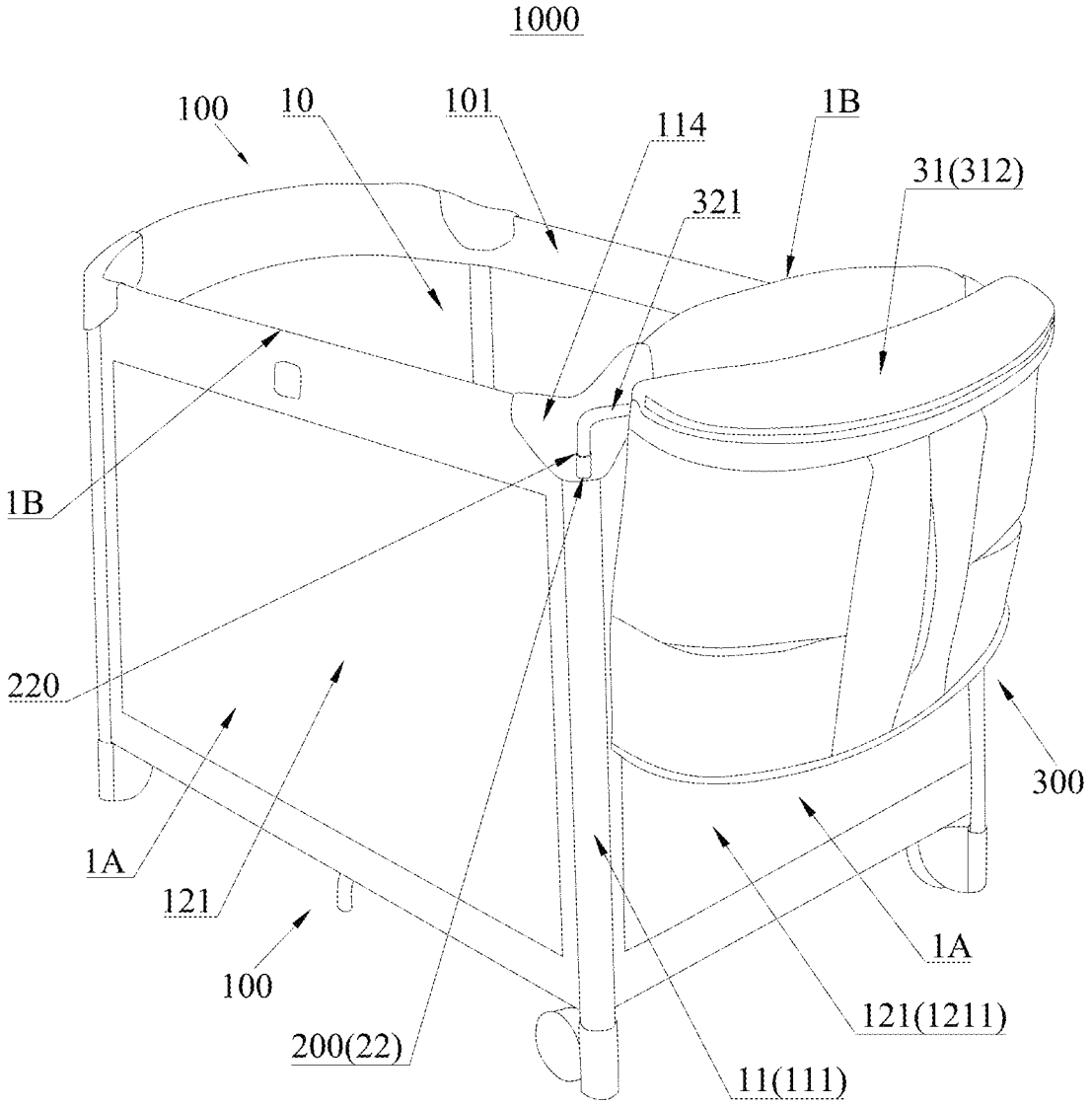
FIG. 20 schematically illustrates a perspective view of a child containment device according to a sixth embodiment in the first aspect of the present application.

FIG. 20 illustrates a perspective view of a child containment device 1000 provided according to a sixth embodiment in the first aspect of the present application, which is a variant of the child containment device 1000 of the first embodiment in the first aspect as described above. The main difference between the child containment device 1000 in this embodiment and the child containment device 1000 provided in the first embodiment as described above is in the implementation manner of the first connecting member 200. As long as there is no contradiction, the structures of the components and the connection relationships between the components in this embodiment can be referenced to those described in the fourth embodiment.

Referring to FIG. 20, the containment body 100 may include a support frame 11 and an enclosing fabric 121. The support frame 11 includes a plurality of support legs 111 and top corner members 114 connected to upper ends of the support legs 111. One or more first connecting members 200 is provided at an outer side of one or more top corner members 114. The top corner member 114 is, for example, integrated with the corresponding first connecting member 200. The first connecting member 200 has, for example, a second housing part 22. Each of the second connecting members 321 of the storage basket 300 may be detachably inserted into the insertion slot 220 of the corresponding second housing part 22.

It should be noted that in some alternative embodiments, the child containment device 1000 may, for example, have the following variants:

I. The containment body 100 may have a variety of configurations, and the support frame 11 and the enclosing fabric 121 may be implemented in different manners accordingly. For example, in some embodiments, the support frame 11 of the containment body 100 encloses, for example, a containment space 10 with a circular cross-section, and the enclosing fabric 121 is disposed along the periphery of the support frame 11, where the containment body 100 may have only one annular side face 1A. Alternatively, the support frame 11 of the containment body 100, for example, encloses a containment space with a triangular cross-section, the enclosing fabric is disposed along the periphery of the support frame 11, and the containment body 100 has, for example, three side faces 1A corresponding, for example, to three sides of the triangle.

II. The enclosing fabric 121 of the containment body 100 may be replaced with a rigid sheet, which is connected to the support frame 11 to enclose the containment space 10.

III. Although the child containment device 1000 in the above embodiments is provided with the storage basket 300, the child containment device 1000 without the storage basket is also within the scope of protection of the present application.

The child containment device provided in the first aspect of the present application allows the storage body to be positioned at the outer side of the side face when connected to the containment body, ensuring that the storage basket does not occupy the space above the containment body, thus not affecting the installation of one or more child support accessories in the space above the containment body. In addition, since the first connecting member is lower than the top edge of the corresponding side face, it provides a lower connection position for the second connecting member, without occupying the area of the top edge, and does not hinder the installation of the adapter of the child support accessory at the top edge, thereby providing convenience for the user.

Figure 21:
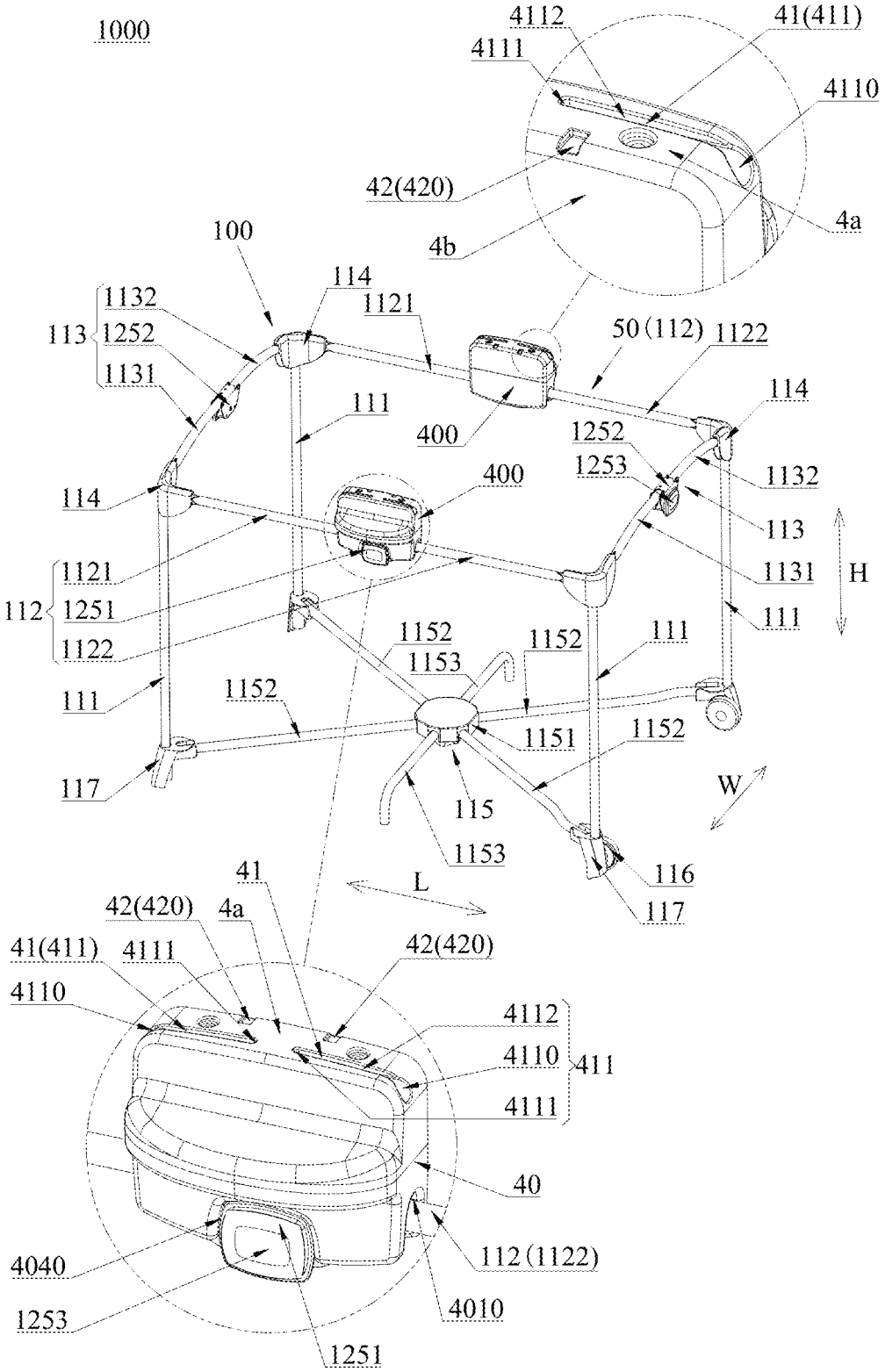
FIG. 21 schematically illustrates a perspective view of a child containment device according to some embodiments in a second aspect of the present application, the child containment device including a child containment body and a mounting base according to embodiments in the second aspect of the present application.
Figure 22:
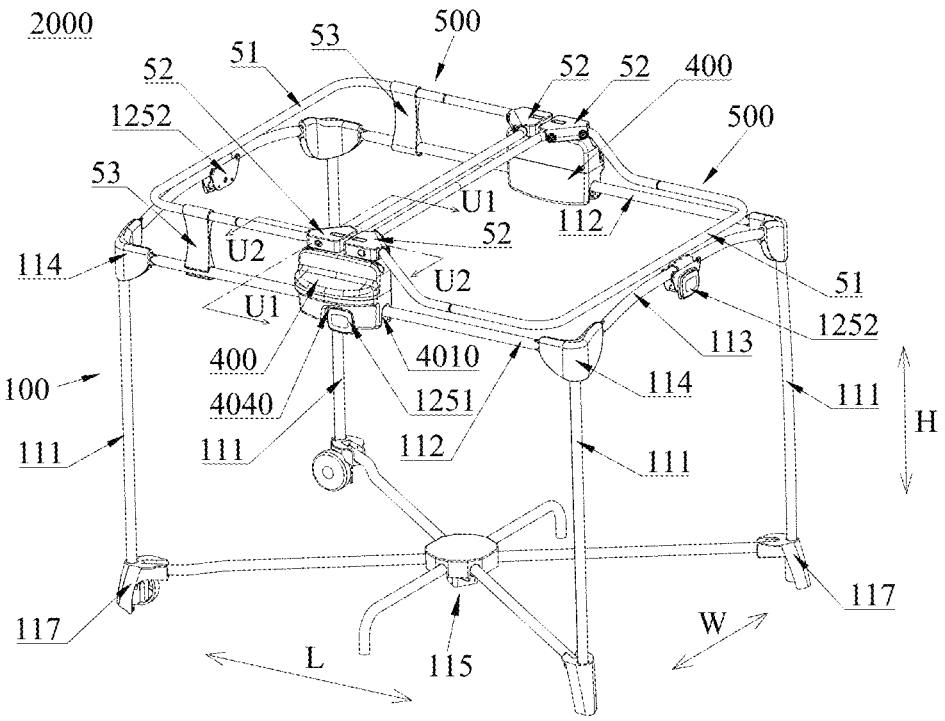
FIG. 22 schematically illustrates a perspective view of a child containment assembly according to some embodiments in the second aspect of the present application, the child containment assembly including the child containment device shown in FIG. 21 and a carrier accessory according to embodiments in the second aspect of the present application, the carrier accessory including a connecting base according to embodiments in the second aspect of the present application.

FIG. 21 schematically illustrates a perspective view of a child containment device 1000 provided according to embodiments in a second aspect of the present application. The child containment device 1000 includes a child containment body (which may also be referred to as a containment body) 100 and a mounting base 400 provided according to embodiments in the second aspect of the present application. FIG. 22 schematically illustrates a perspective view of a child containment assembly 2000 provided according to embodiments in the second aspect of the present application. The child containment assembly 2000 includes the child containment device 1000 provided according to embodiments in the second aspect of the present application and a carrier accessory 500 provided according to embodiments in the second aspect of the present application. The carrier accessory 500 includes a connecting base 52 provided according to embodiments in the second aspect of the present application. The child containment device 1000 and the child containment assembly 2000 will be described below, along with the mounting base 400, the carrier accessory 500, and the connecting base 52.

Referring to FIG. 21, in some embodiments in the second aspect of the present application, the child containment device 1000 includes a child containment body 100 and two mounting bases 400 mounted on the child containment body 100. The child containment body 100 in FIG. 21 is illustrated with a child playard as an example, but in some alternative embodiments, the child containment body 100 may, for example, be a baby crib, a playpen, or other forms of child containment body 100.

FIG. 21 shows an exemplary embodiment of the child containment body 100. The child containment body 100 may include a playard frame (which may also be referred to as a support frame) and an enclosure which is not shown. The playard frame may include two parallel handrails 112 (which may also be referred to as long handrails), two parallel handrails 113 (which may also be referred to as short handrails), four support legs 111, a connecting assembly 115 (which may also be referred to as a connecting frame), four top corner members 114, and four feet 117. The enclosure may be made of a fabric. For example, the enclosure may be an enclosing fabric. The enclosure connected to the playard frame defines a containment space of the child containment body 100. The children can play in the containment space. It should be understood that in some alternative embodiments, the child containment body 100 can be implemented in other manners and is limited to the embodiments described herein.

Continuing with reference to FIG. 21, the handrails 112 and the handrails 113 can form a rectangular shape. The handrail 112 and the handrail 113 adjacent to each other are connected by the top corner member 114. In some embodiments, the handrails 112 and the handrails 113 may each be a single tube which is non-foldable. Alternatively, as shown in FIG. 21, the handrails 112 and the handrails 113 may each includes a plurality of tubes, allowing for the folding of the handrails 112 and the handrails 113, thereby enabling the playard frame to be foldable. Specifically, the handrails 112 may each include a first tube 1121, a second tube 1122, and a first seat 1251. Ends of the first tube 1121 and the second tube 1122 that are close to each other may be pivotally connected to the first seat 1251. Ends of the first tube 1121 and the second tube 1122 that are away from each other may be pivotally connected to the corresponding top corner members 114, respectively. The handrails 113 may each include a third tube 1131, a fourth tube 1132, and a second seat 1252. Ends of the third tube 1131 and the fourth tube 1132 that are close to each other may be pivotally connected to the second seat 1252. Ends of the third tube 1131 and the fourth tube 1132 that are away from each other may be pivotally connected to the corresponding top corner members 114, respectively.

The first seat 1251 of the handrail 112 and the second seat 1252 of the handrail 113 can have substantially the same structure, for example, including a locking member (not shown) and an unlocking push-button 1253. The locking member can lock the two tubes pivotally connected to the seat in an unfolded state as shown in FIG. 21. The unlocking push-button 1253 can drive the locking member to unlock the two tubes to allow the folding of the two tubes pivotally connected to the seat.

In some embodiments, the length of the handrail 112 is greater than the length of the handrail 113. The extending direction of the handrail 112 may be referred to as the length direction L of the child containment body 100, and the extending direction of the handrail 113 may be referred to as the width direction W of the child containment body 100. The handrails 112, the handrails 113, and the top corner members 114 may be collectively referred to as a handrail assembly.

In some embodiments, the support legs 111 may each include a vertical tube. The extending direction of the support legs 111 may be referred to as the height direction H of the child containment body 100. The upper ends of the four support legs 111 are connected to the four top corner members 114, respectively. The lower ends of the four support legs 111 are connected to the four feet 117, respectively. In some embodiments, the feet 117 are each provided with a wheel 116.

In some embodiments, the feet 117 may be connected to a connecting assembly 115. FIG. 21 shows an exemplary embodiment of the connecting assembly 115. The connecting assembly 115 may include a central pivoting member 1151, four fifth tubes 1152 and two auxiliary brackets 1153. One end of each of the four fifth tubes 1152 is pivotably connected to the central pivoting member 1151. The other end of each of the four fifth tubes 1152 is pivotably connected to the corresponding one of the four feet 117. One end of each of the auxiliary brackets 1153 is pivotably connected to the central pivoting member 1151. The other ends of the auxiliary brackets 1153 are positioned away from each other and in contact with the ground. The extending direction of the two auxiliary brackets 1153 is, for example, parallel to the width direction W of the child containment body 100. It should be understood that the connecting assembly 115 may be implemented by other manners and is not limited to the embodiment above.

Figure 23:
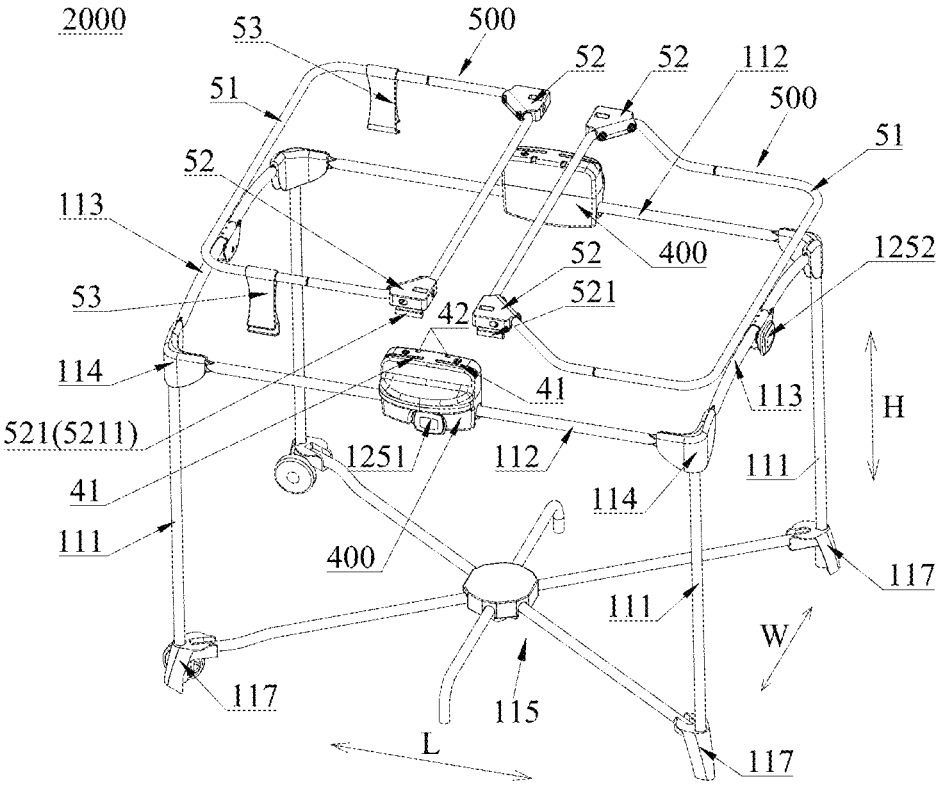
FIG. 23 schematically illustrates a perspective view of the carrier accessory shown in FIG. 22 detached from the corresponding mounting base.

Continuing with reference to FIG. 21, the two mounting bases 400 are mounted on two handrails of the child containment body 100, specifically on two handrails 112, respectively. The handrail 112 may also be referred to as a support member 50 for mounting the mounting base 400. The structures of the two mounting bases 400 are generally symmetrical to each other, and one of the mounting bases 400 will be described below as an example. Referring in conjunction to FIG. 21 to FIG. 23, the mounting base 400 includes, for example, at least two first connecting parts 41 adapted to be connected to the second connecting parts 521 of the connecting bases 52 of at least two carrier accessories 500 so that the mounting base 400 can be simultaneously connected to at least two carrier accessories 500. That is, multiple carrier accessories 500 may be connected to the playard frame of the child containment body via a common mounting base 400, which reduces the number of the mounting bases 400, helps to reduce the weight and cost of the child containment assembly 2000, and effectively avoids the mounting bases 400 from being lost due to poor storage.

Referring to FIG. 22 which shows an exemplary perspective view of the child containment assembly 2000. In some embodiments, the mounting base 400 on each of the handrails 112 is connected to two carrier accessories 500 simultaneously, enabling two carrier accessories 500 to be supported on the child containment body 100 simultaneously using fewer mounting bases 400. The two carrier accessories 500 are arranged, for example, next to each other in the length direction L. The carrier accessories 500 may be each independently selected from a changing table, a sleeping basket, a hammock, a rod for a toy, a tray, and the like. In the case of a carrier accessory 500 formed by a changing table or a sleeping basket, the carrier accessory 500 may include a carrier frame 51, two connecting bases 52, and a support fabric that is not shown. The support fabric is connected to the carrier frame 51 of the carrier accessory 500 to form a space for receiving a child. The connecting bases 52 are, for example, plastic components and are mounted on the carrier frame 51. The connecting bases 52 each include a second connecting part 521 for connecting to one of the at least two first connecting parts 41 of the corresponding mounting base 400.

Referring to FIG. 23 which shows a perspective view of the child containment assembly 2000, the second connecting parts 521 of the connecting bases 52 of the carrier accessories 500 are respectively detachably connected to the corresponding first connecting parts 41, allowing the carrier accessories 500 to be detachably connected to the corresponding mounting bases 400. This enables users to change the carrier accessories 500 as needed or selectively install one or more carrier accessories 500 on the child containment body 100.

Figure 24:
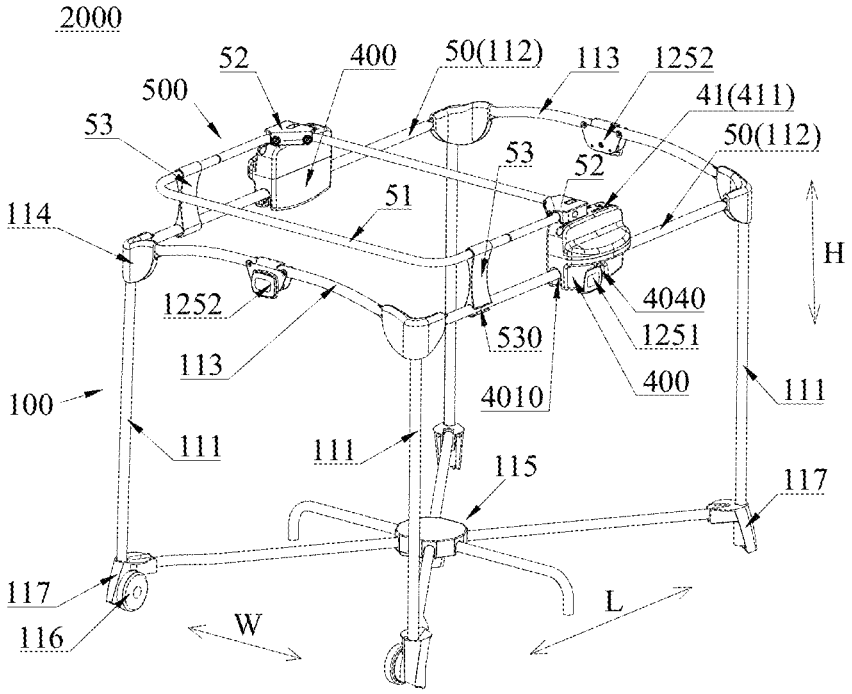
FIG. 24 schematically illustrates a state of use of the child containment assembly shown in FIG. 22.
Figure 25:
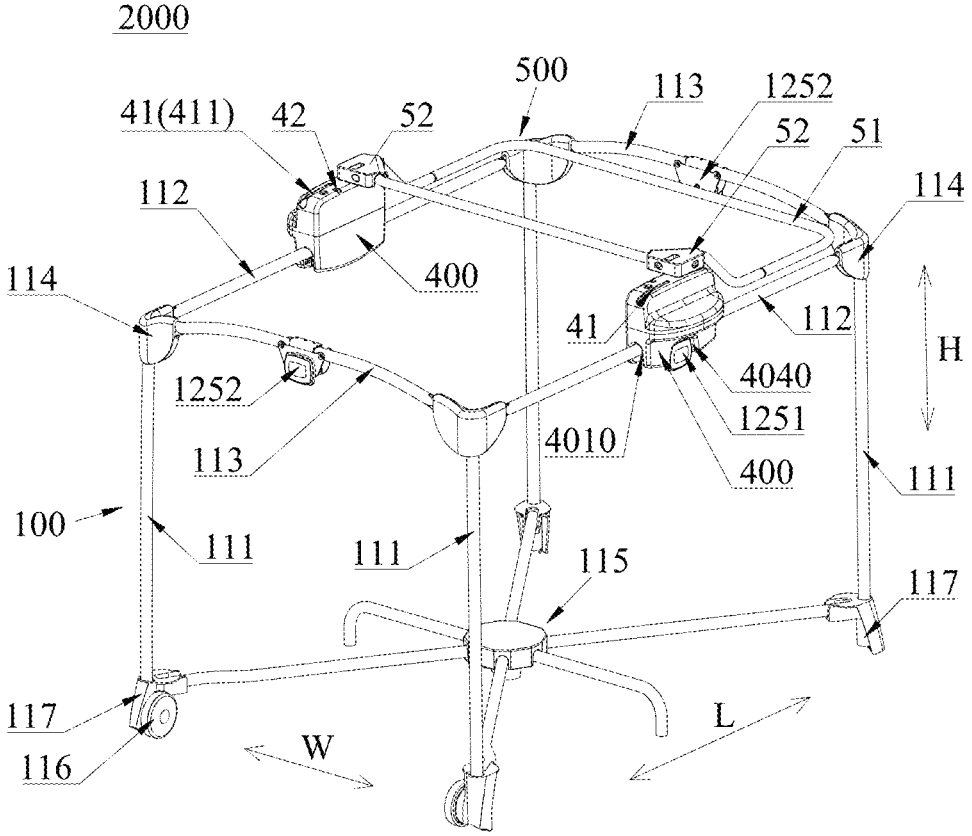
FIG. 25 schematically illustrates another state of use of the child containment assembly shown in FIG. 22.

Referring to FIG. 22, FIG. 24, and FIG. 25, in some embodiments, by detachably connecting the carrier accessories 500 to the mounting bases 400, the child containment assembly 2000 can be used in various modes. In one mode as shown in FIG. 22, two carrier accessories 500 are simultaneously supported on the child containment body 100 via two mounting bases 400. In modes shown in FIG. 24 and FIG. 25, the two carrier accessories 500 shown in FIG. 22 are individually supported on the child containment body 100.

Furthermore, in some alternative embodiments, the second connecting parts 521 of the connecting bases 52 of at least one carrier accessory 500 are respectively non-detachably connected to the corresponding first connecting parts 41, while the second connecting parts 521 of the connecting bases 52 of at least one carrier accessory 500 are respectively detachably connected to the corresponding first connecting parts 41. This allows at least one carrier accessory 500 to be non-detachably connected to the corresponding mounting bases and at least one carrier accessory 500 to be detachably connected to the corresponding mounting bases, thereby enabling users to change the detachable carrier accessories 500 in different types as needed.

Referring again to FIG. 24, in some embodiments, at least one carrier accessory 500 is not only connected to the mounting bases 400 via the connecting bases 52, but may also be connected to the handrails 112 via a strut 53. One end of the strut 53 is, for example, pivotally connected to the carrier frame 51, and the other end of the strut 53 may be engaged with the handrail 112 via an engagement opening 530. The strut 53 is used to further support the carrier accessory 500.

Figure 26:
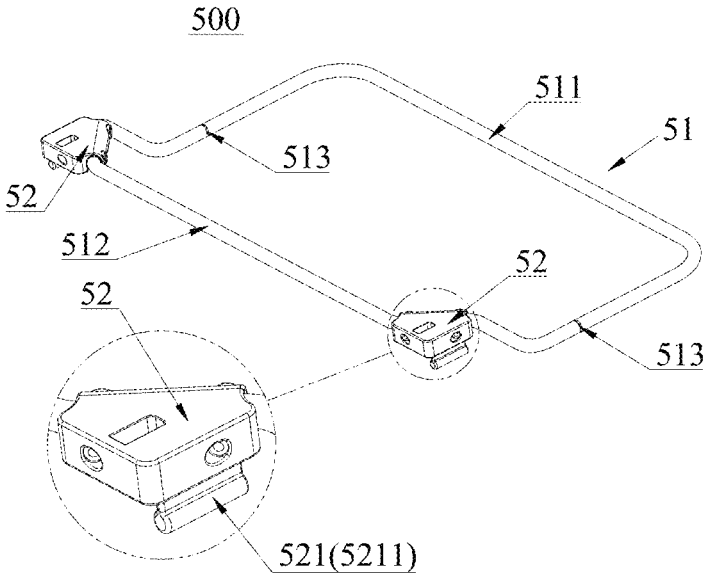
FIG. 26 schematically illustrates a top perspective view of the carrier accessory shown in FIG. 23.
Figure 27:
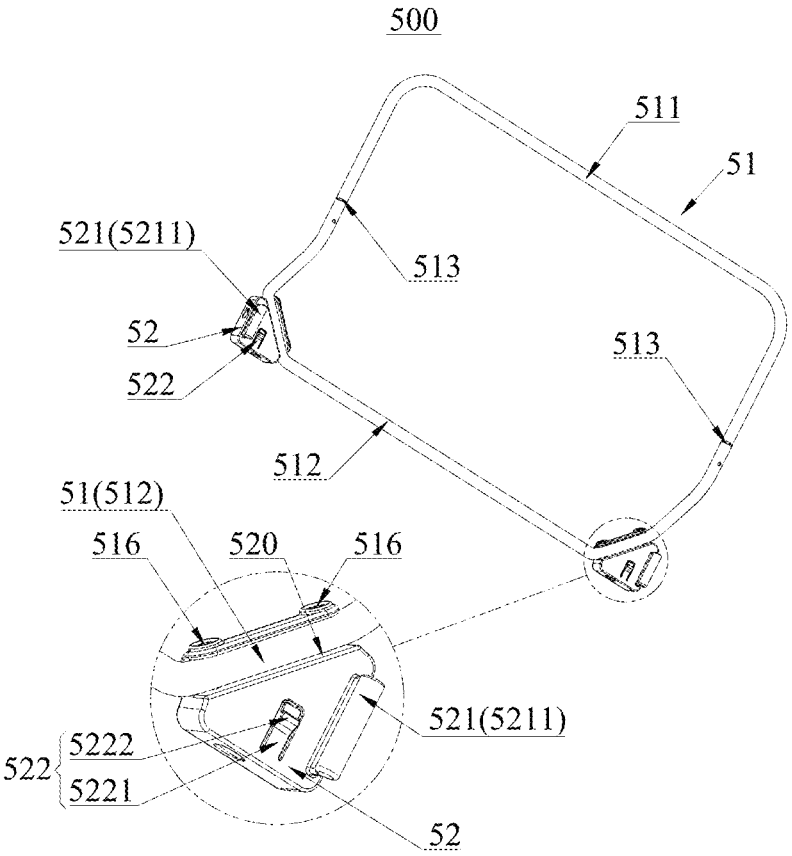
FIG. 27 schematically illustrates a bottom perspective view of the carrier accessory shown in FIG. 23.

FIG. 26 and FIG. 27 show an exemplary structure of the carrier accessory 500. The carrier frame 51 includes, for example, a first U-shaped frame 511 and a second U-shaped frame 512. The first U-shaped frame 511 and the second U-shaped frame 512 are jointed together at a joint 513. Two connecting bases 52 are mounted on two corners of the second U-shaped frame 512, respectively, and each provided with an engagement groove 520. The second U-shaped frame 512 is engaged with the engagement groove 520. Multiple fasteners 516 pass through a wall of the engagement groove 520 to be connected to the U-shaped frame 512 to avoid accidental disengagement of the carrier frame 51 from the engagement groove 520.

Referring to FIG. 21, FIG. 26, and FIG. 27, a schematic connecting manner of the mounting base 400 and the connecting base 52 is shown. In some embodiments, the first connecting parts 41 of the mounting base 400 are, for example, respectively slidably connected to the corresponding second connecting parts 521 of the connecting bases 52. More specifically, the first connecting parts 41 each include, for example, a slide groove 411 extending in a first direction parallel to the extending direction of the handrail 112. In this embodiment, the first direction is also the length direction L as described above. As shown in FIG. 21, in some embodiments, the mounting base 400 includes two first connecting parts 41 each including a slide groove 411. The slide groove 411 includes a base wall 4111, a mounting port 4110, and a top opening 4112. The mounting port 4110 is opposite to the base wall 4111. The top opening 4112 extends from the mounting port 4110 to the base wall 4111. The base walls 4111 of the slide grooves 411 of the two first connecting parts 41 are close to each other, and the mounting ports 4110 of the slide grooves 411 of the two first connecting parts 41 are away from each other. Referring to FIG. 26 and FIG. 27, the second connecting parts 521 each include a slide rail 5211 also extending in the first direction. The slide rails 5211 are respectively in slidable cooperation with the corresponding slide grooves 411. More specifically, the slide rails 5211 may slide into the corresponding slide grooves 411 through the mounting ports 4110 of the corresponding slide grooves 411, and the sliding depths of the slide rails 5211 may be limited by the base walls 4111 of the corresponding slide grooves 411.

Figure 28:
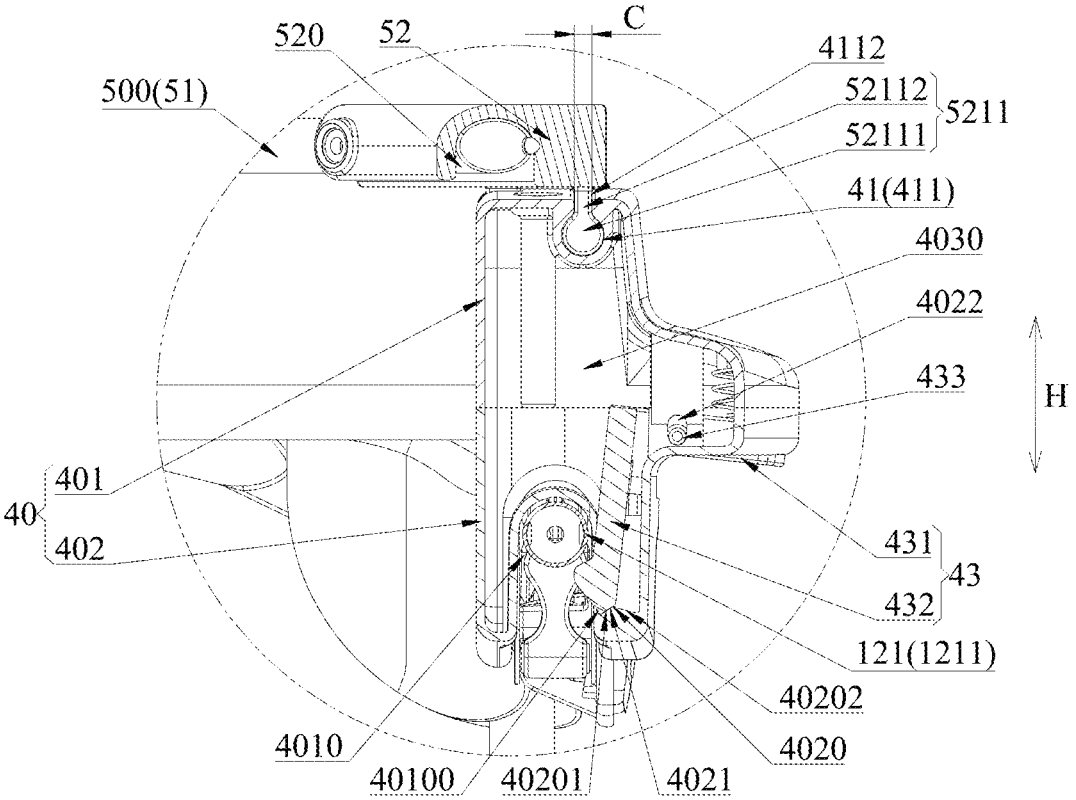
FIG. 28 schematically illustrates a sectional view taken along line U1-U1 shown in FIG. 22 with a locking member in a locking position.
Figure 29:
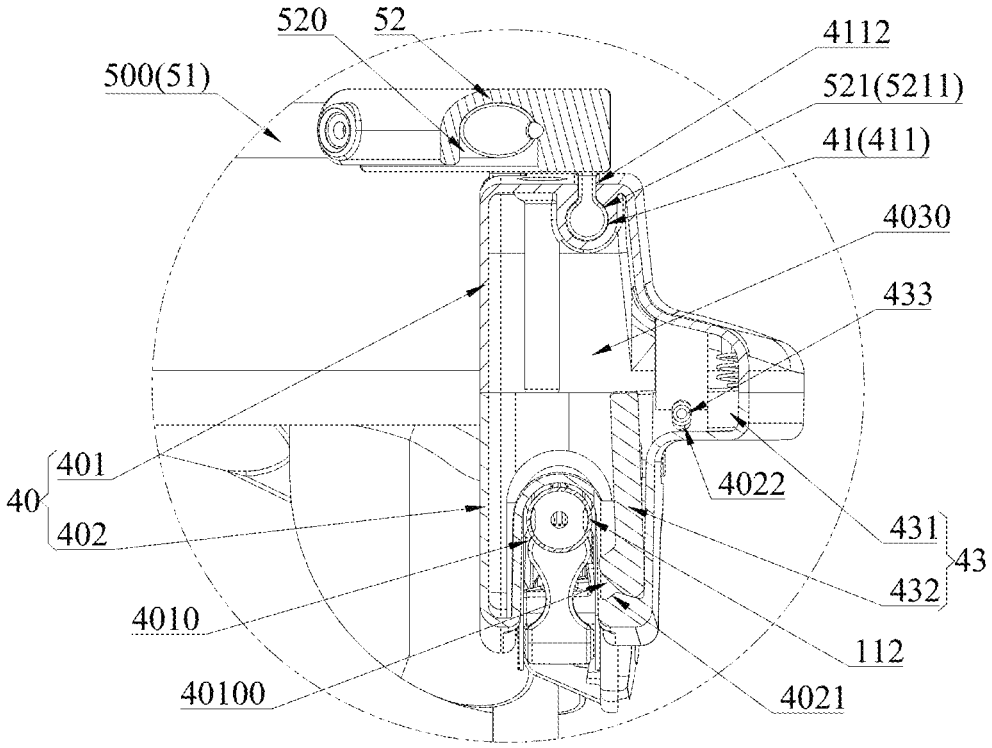
FIG. 29 schematically illustrates a sectional view taken along line U1-U1 shown in FIG. 22 with the locking member in an unlocking position.

Referring to FIG. 28 and FIG. 29, the slide groove 411 and the slide rail 5211 that cooperate with each other can be shaped in cross-section to restrict the relative movement of the first connecting part 41 to the second connecting part 521 in the second direction perpendicular to the first direction. In this embodiment, the second direction is also the height direction H as described above. In this way, the mounting and dismounting directions of the connecting bases 52 and the mounting bases 400 are limited to the horizontal direction, so that the accidental detachment of the carrier accessory 500 from the mounting bases 400 when the carrier accessory 500 is lifted upward can be avoided. Referring to FIG. 28, in some embodiments, the slide rail 5211 includes a connecting rib 52112 protruding from the connecting base 52 and a cylindrical body 52111 connected to the connecting rib 52112. The cylindrical body 52111 is in slidable cooperation with the slide groove 411. The connecting rib 52112 is in slidable cooperation with the top opening 4112 of the slide groove 411. A thickness C of the connecting rib 52112 is less than a diameter of the cylindrical body 52111. The top opening 4112 is sized to allow the connecting rib 52112 to pass therethrough in the height direction H, but to restrict the cylindrical body 52111 from passing therethrough in the height direction H. In this way, when the connecting base 52 is slidably connected to the mounting base 400, the carrier accessory 500 will not be detached from the mounting base 400 due to a force of upward lift only, and the carrier accessory 500 will not be rotated relative to the mounting base 400. It should be understood that in some alternative embodiments, the cross-section shapes of the slide groove 411 and the slide rail 5211 may be implemented in other manners and is limited to the above embodiments.

Figure 30:
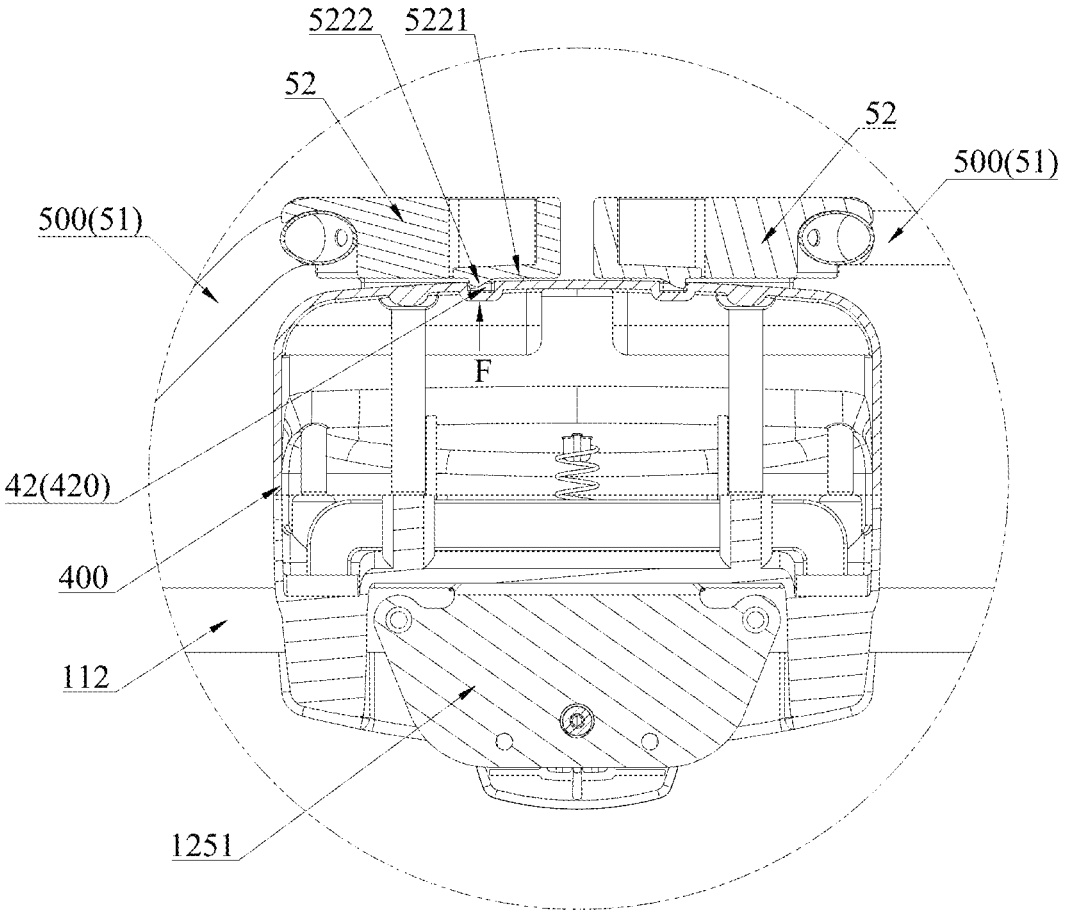
FIG. 30 schematically illustrates a sectional view taken along line U2-U2 shown in FIG. 22.

Referring to FIG. 21, FIG. 27, and FIG. 30, in some embodiments, the mounting base 400 is provided with a first limiting structure 42, and at least one connecting base 52 of at least one carrier accessory 500 may be provided with a second limiting structure 522. The first limiting structure 42 is adapted to cooperate with the second limiting structure 522 to restrict the relative position of the first connecting part 41 to the second connecting part 521 to preventing the slide rail 5211 from sliding out horizontally from the slide groove 411.

FIG. 21 shows an exemplary embodiment of the first limiting structure 42, which includes, for example, a limiting groove 420 that is recessed relative to a top wall **4*a* and a side wall 4*b* adjacent to the top wall 4*a* of the mounting base 400. FIG. 27 shows an exemplary embodiment of the second limiting structure 522, which includes, for example, an elastic arm 5221 and a limiting protrusion 5222 protruded from the elastic arm 5221. The extending direction of the elastic arm 5221 is parallel to the first direction, i.e., parallel to the extending direction of the slide rail 5211. The limiting protrusion 5222 is located proximate to the free end of the elastic arm 5221. During the installation of the carrier accessory 500 onto the mounting base 400, once the slide rail 5211 slides into place along the slide groove 411, the limiting protrusion 5222 engages with the limiting groove 420, thereby restricting the slide rail 5211 within the slide groove 411, as shown in FIG. 30**.

Referring to FIG. 30, in order to remove the carrier accessory 500 from the mounting base 400, an upward force F can be applied to the limiting protrusion 5222 from below the connecting base 52 to disengage the limiting protrusion 5222 from the limiting groove 420, allowing the slide rail 5211 to be horizontally moved out from the slide groove 411. It should be understood that to facilitate the application of the force F to the limiting protrusion 5222, when the limiting protrusion 5222 is engaged with the limiting groove 420, a part of the limiting protrusion 5222 protrudes from the side wall **4*b* of the mounting base 400**.

Figure 31:
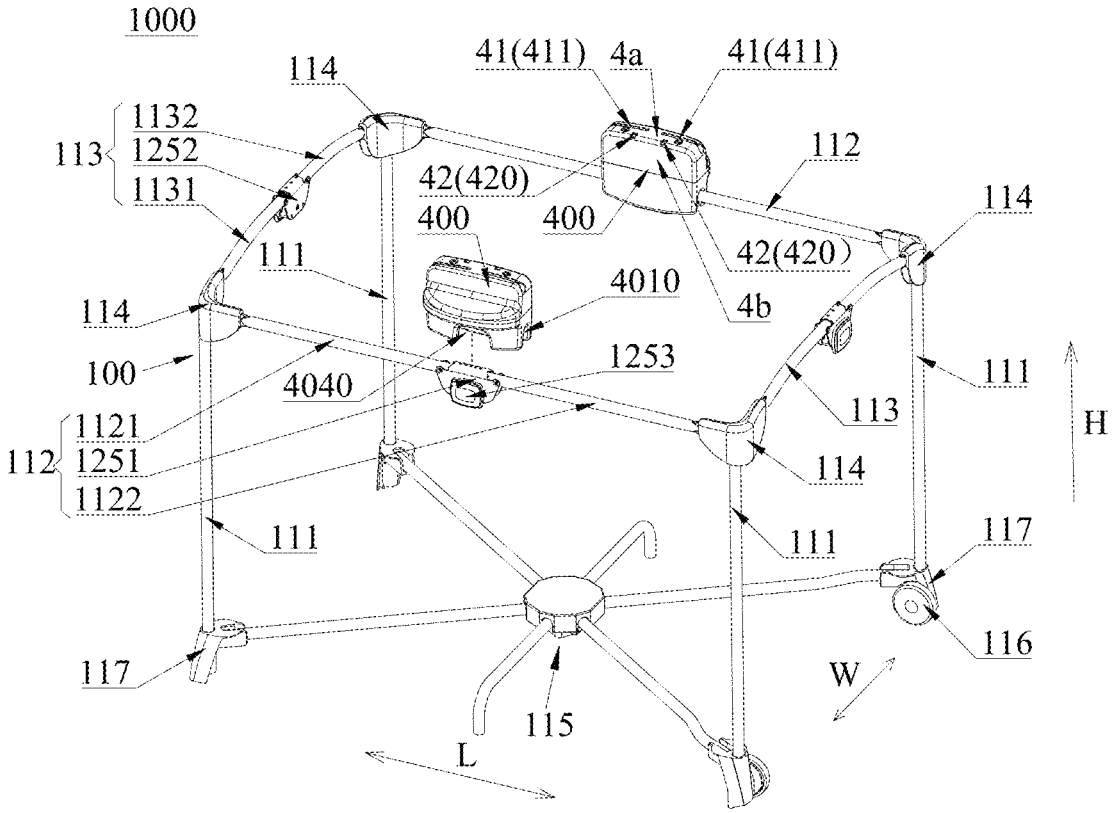
FIG. 31 schematically illustrates a perspective view of the child containment device shown in FIG. 21, with the mounting base detached from the child containment body.

FIG. 31 shows another perspective view of the child containment device 1000. Although only one mounting base 400 is shown detached from the handrail 112 in FIG. 31, in practice, all mounting bases 400 can be detachably connected to the handrails 112. In this way, all mounting bases 400 can be removed from the handrails 112 when there is no need to install any carrier accessory 500 on the containment body 100.

Figure 32:
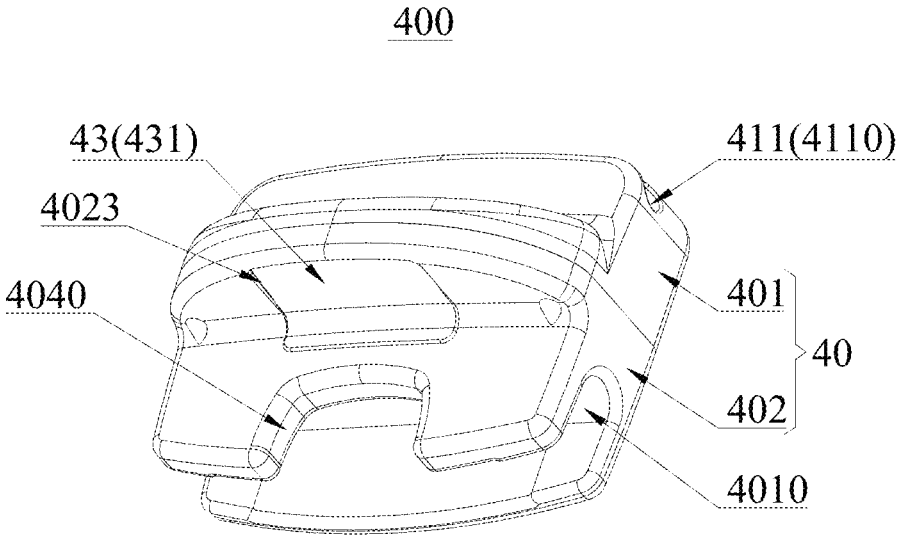
FIG. 32 schematically illustrates a perspective view of the mounting base shown in FIG. 21.
Figure 33:
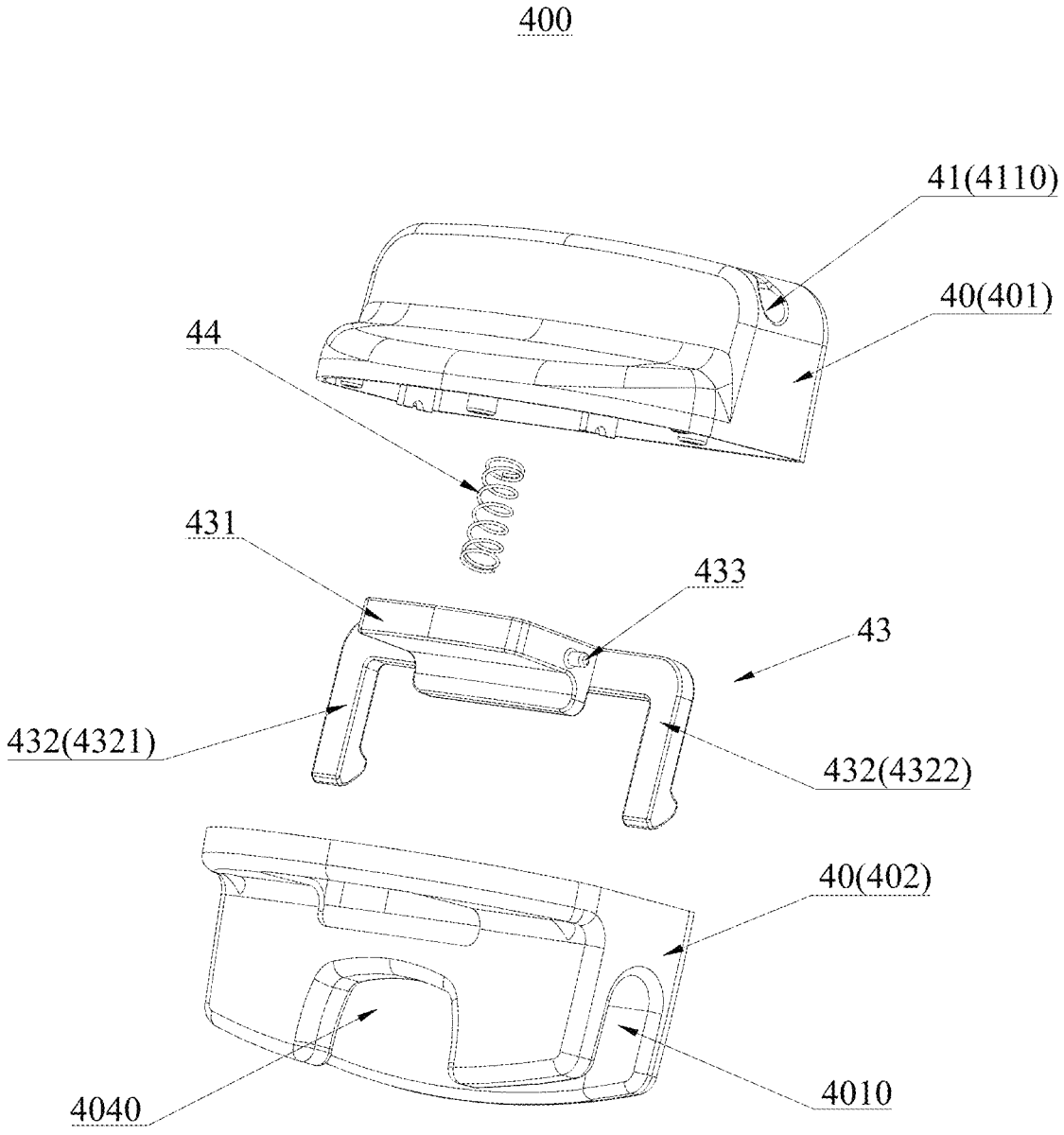
FIG. 33 schematically illustrates an exploded view of the mounting base shown in FIG. 32.

FIG. 32 and FIG. 33 show an exemplary embodiment of the mounting base 400. In some embodiments, the mounting base 400 includes, for example, a shell 40, a locking member 43, and a resilient member 44. The shell 40 includes, for example, an upper shell 401 and a lower shell 40. The upper shell 401 and the lower shell 402 may define an inner cavity 4030 (see FIG. 28). The first connecting part 41 and the first limiting structure 42 are provided, for example, on the upper shell 401. The lower shell 402 is formed with, for example, an engagement cavity 4010, which is, for example, in a U-shaped groove structure and is used to accommodate the handrail 112. The locking member 43 is connected to the shell 40 and has a locking position and an unlocking position. Referring to FIG. 28, the locking member 43 is adapted to keep the handrail 112 in the engagement cavity 4010 when the locking member 43 is in the locking position. Referring to FIG. 29, the locking member 43 allows the mounting base 400 to be detached from the handrail 112 when the locking member 43 is in the unlocking position. The resilient member 44 is used to apply a force to the locking member 43 that biases the locking member 43 toward the locking position to keep the locking member 43 in the locking position.

Continuing with reference to FIG. 28 and FIG. 29, in some embodiments, at least a part of the locking member 43 is located in the inner cavity 4030, and the locking member 43 is pivotally connected to the shell 40 by a pivot shaft 433 and is pivotable between the locking position and the unlocking position. More specifically, the locking member 43 includes, for example, an unlocking part 431, the pivot shaft 433, and at least one hook part 432. The shell 40 is provided with an opening 4023 at a position corresponding to the unlocking part 431 (see FIG. 32). The cavity wall of the engagement cavity 4010 is provided with an opening 40100 for the hook part 432 to pass therethrough (see FIG. 28). Referring to FIG. 28, when the locking member 43 is in the locking position, the hook part 432 is stretched into the engagement cavity 4010 through the opening 40100 to be engaged with the handrail 112, thereby keeping the handrail 112 in the engagement cavity 4010 without being detachable from the mounting base 400. It should be noted that the gap between the hook part 432 and the handrail 112 in FIG. 28 corresponds to the space occupied by the enclosure that is not shown. Referring to FIG. 29, when the unlocking part 431 is subjected to an unlocking force, the locking member 43 is rotated around the pivot shaft 433 to the unlocking position such that the hook part 432 can be disengaged from the handrail 112, in this case, the mounting base 400 can be removed from the handrail 112. The resilient member 44 may be a compression spring mounted between the locking member 43 and the shell 40, or a torsion spring sleeved onto the pivot shaft 433 and connected to both the locking member 43 and the shell 40.

Continuing with reference to FIG. 28, in some embodiments, the shell 40 may also be provided with an abutment part 4021. When the locking member 43 is in the locking position, the abutment part 4021 abuts against the hook part 432 to further keep the locking member 43 in the locking position, preventing accidental unlocking of the locking member 43. In some embodiments, a bottom of the opening 40100 is formed, for example, with a peaked structure including a peak 4020 and two slopes 40201 and 40202 extending from the peak 4020. The abutment part 4021 is formed, for example, on the slope 40201. When the locking member 43 is in the locking position, an end part of the hook part 432 abuts against the abutment part 4021, and the abutment part 4021 exerts a force on the hook part 432 that prevents the locking member 43 from rotating toward the unlocking position.

Referring to FIG. 28 and FIG. 29, in some embodiments, the shell 40 may be provided with an elongated hole 4022 in which the pivot shaft 433 is mounted. When the unlocking part 431 is subjected to an unlocking force, the pivot shaft 433 moves upward along the elongated hole 4022 so that the end part of the hook part 432 is disengaged from the abutment part 4021 and crosses over the peak 4020, after which the locking member 43 is rotated around the pivot shaft 433 toward the unlocking position. When the locking member 43 reaches the unlocking position, the end part of the hook part 432 may rest against the slope 40202. It should be understood that when the unlocking part 431 is subjected to no unlocking force, the resilient member 44 drives the locking member 43 to rotate around the pivot shaft 433 while driving the pivot shaft 433 to move downward along the elongated hole 4022. The driving force of the resilient member 44 is sufficient to cause the end part of the hook part 432 to cross over the peak 4020 to abut against the abutment part 4021.

In some embodiments, the shape of the hook part 432 is designed to allow the handrail 112 to enter the engagement cavity 4010 and engage with the hook part 432 without operating the unlocking part 431. During insertion of the handrail 112 into the engagement cavity 4010, the handrail 112 pushes the end part of the hook part 432 to cross over the peak 4020 to reach the slope 40202. Once the handrail 112 is inserted in place into the engagement cavity 4010, the resilient member 44 pushes the locking member 43 to cause the end part of the hook part 432 to cross over the peak 4020 and abut against the abutment part 4021. It should be noted that in some alternative embodiments, the positions of the elongated hole 4022 and the pivot shaft 433 on the shell 40 and the locking member 43 are interchangeable.

Referring again to FIG. 31 and FIG. 33, in some embodiments, the engagement cavity 4010 of the mounting base 400 is connected to the handrail 112 at the location of the first seat 1251 of the handrail 112. The contact of the wall of the engagement cavity 4010 with the first seat 1251 may also restricts the rotation of the mounting base 400 around the handrail 112, so that no additional positioning structure is required to prevent the relative rotation of the mounting base 400 to the handrail 112. The mounting base 400 may have a recessed part 4040 located corresponding to the unlocking press-button 1253. The unlocking press-button 1253 is exposed through the recessed part 4040. In some embodiment, the hook part 432 of the locking member 43 includes a first hook part 4321 and a second hook part 4322 spaced apart from each other. The first hook part 4321 and the second hook part 4322 engage with the first tube 1121 and the second tube 1122 of the handrail 112, respectively. The first seat 1251 on the handrail 112 is positioned between the first hook part 4321 and the second hook part 4322. Both a hook body of the first hook part 4321 stretched into the engagement cavity 4010 through the opening 40100 and a hook body of the second hook part 4322 stretched into the engagement cavity 4010 through the opening 40100 cooperate with the first seat 1251 to restrict the movement of the mounting base 400 along the handrail 112. In this way, there is no need to provide an additional positioning structure on the handrail 112 that prevents the horizontal movement of the mounting base 400 relative to the handrail 112.

It should be noted that although the first seat 1251 described above is a pivoting seat pivotally connected to two adjacent tubes of the handrail 112, in other embodiments where, for example, the handrail 112 adopts a single non-foldable tube, the first seat 1251 may be fixed on the handrail 112 rather than being pivotally connected to the handrail 112.

It should be noted that although the first connecting part 41 includes the slide groove 411 and the second connecting part 521 includes the slide rail 5211 in the above embodiments, the positions of the slide groove 411 and the slide rail 5211 on the first connecting part 41 and the second connecting part 521 may be interchangeable in some alternative embodiments. That is, the first connecting part 41 may include the slide rail, and the second connecting part 521 may include the slide groove. The slide groove of the second connecting part 521 accordingly includes a base wall, a mounting port, and a bottom opening. The bottom opening extends from the mounting port to the base wall. The slide rail of the first connecting part 41 can slide into the slide groove through the mounting port of the slide groove of the second connecting part 521. As well, the cross-sectional shapes of the slide rail of the first connecting part 41 and the slide groove of the second connecting part 521 may be provided to restrict the relative movement of the first connecting part 41 and the second connecting part 521 in the height direction H. The structures of the first limiting structure 42 and the second limiting structure 522 can be referenced to those as described above.

It should be noted that although one mounting base 400 is mounted on one handrail 112 in the above embodiments, two or more mounting bases 400 may be mounted on the same handrail 112 in some alternative embodiments. It should be understood that two or more mounting bases 400 may support three or more carrier accessories 500 on the child containment body 100.

Figure 34:
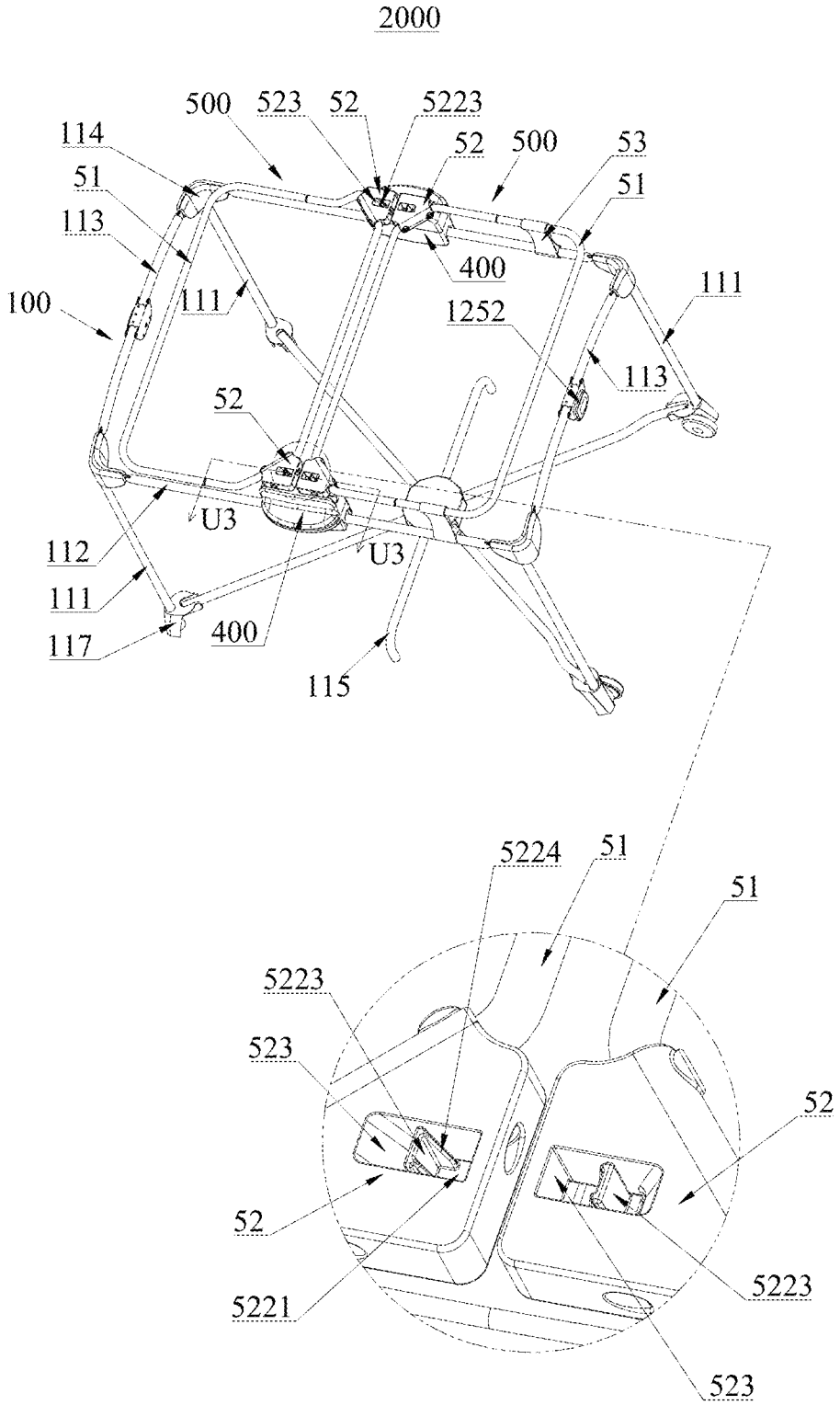
FIG. 34 schematically illustrates a perspective view of a child containment assembly according to some embodiments in the second aspect of the present application, the child containment assembly being a variant of the child containment assembly shown in FIG. 22.

FIG. 34 shows a perspective view of a child containment assembly 2000 provided according to some other embodiments in the second aspect of the present application, which is a variant of the child containment assembly 2000 as shown in FIG. 22. The main difference between those two child containment assemblies 2000 is in the implementation manner of the connecting base 52. As long as there is no contradiction, the structures of the components and the connection relationships between the components in this embodiment can be referenced to those as descried above. The implementation manner of the connecting base 52 in this embodiment will be mainly described below.

Figure 35:
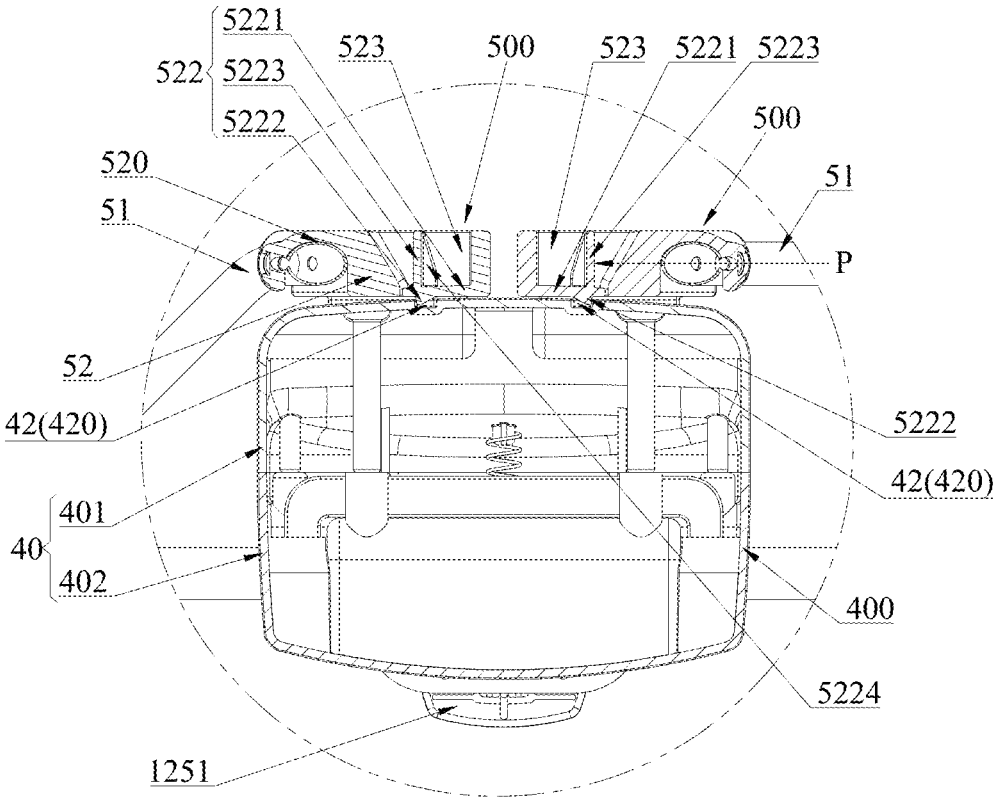
FIG. 35 schematically illustrates a sectional view taken along line U3-U3 shown in FIG. 34.

Referring to FIG. 34, the connecting base 52 has a chamber 523. An operating part 5223 is provided on the elastic arm 5221 and accommodated in the chamber 523. Referring in conjunction to FIG. 35, the operating part 5223 is protruded in a direction opposite to the protrusion direction of the limiting protrusion 5222. When it is to remove the carrier accessory 500 from the mounting base 400, it is convenient to apply a force P to the operating part 5223 through the chamber 523, so that the elastic arm 5221 rotates upwardly while driving the limiting protrusion 5222 to disengage from the corresponding limiting groove 420. Thereafter, the carrier accessory 500 can be removed from the mounting base 400 by moving the carrier accessory 500 horizontally in the first direction. In some embodiments, a reinforcing rib 5224 may also be provided between the operating part 5223 and the elastic arm 5221 to enhance the connection strength of the operating part 5223 and the elastic arm 5221.

Given that the operating part 5223 is provided on the elastic arm 5221 and protruded in a direction opposite to the protrusion direction of the limiting protrusion 5222, the limiting protrusion 5222 can be easily removed from the limiting groove 420 by operating the operating part 5223. This eliminates the need to apply an upward force F to the limiting protrusion 5222 from below the connecting base 52 to disengage the limiting protrusion 5222 from the limiting groove 420. Consequently, it is possible that the limiting protrusion 5222 is not protruded from the side wall **4*b* of the mounting base 400, and the limiting groove 420 is recessed with respect to the top wall 4*a* of the mounting base 400 only but not to the side wall 4*b* of the mounting base 400**.

Figure 36:
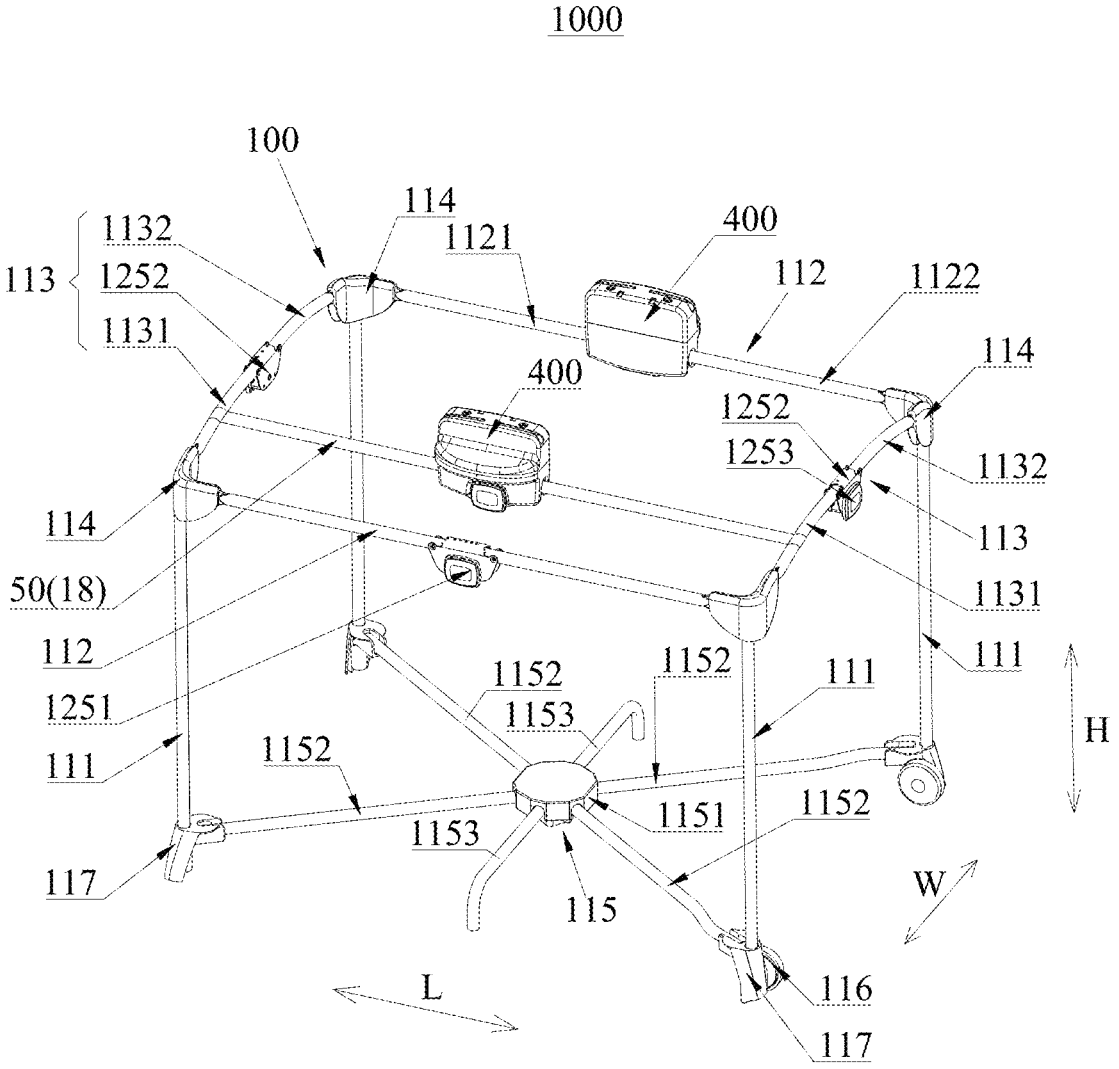
FIG. 36 schematically illustrates a perspective view of a child containment device according to some embodiments in the second aspect of the present application, the child containment device including a child containment g body and a mounting base according to embodiments in the second aspect of the present application.

FIG. 36 shows a perspective view of a child containment device 1000 provided according to some yet other embodiments in the second aspect of the present application, which is a variant of the child containment device 1000 as shown in FIG. 21 or FIG. 34. The main difference between those two child containment devices 1000 is in the implementation manner of the support member 50. As long as there is no contradiction, the structures of the components and the connection relationships between the components in this embodiment can be referenced to those as descried above.

Referring to FIG. 36, the playard frame of the child containment body 100 may also include a support rod 18. Two ends of the support rod 18 are, for example, detachably connected to two opposite handrails 113, respectively. The support rod 18 may serves as the support member 50 for mounting the mounting base 400. The support rod 18 may be a single non-foldable rod, or similarly to the handrails 112 and 113, may include a plurality of tubes and a seat connected between the adjacent tubes. It should be understood that the child containment device 1000 may be mounted with at least one carrier accessory 500 by the mounting base 400.

In some embodiments, the child containment body 100 may be provided with a plurality of mounting bases 400. A part of the plurality of mounting bases 400 may be mounted on the support rod 18, and another part of the plurality of mounting bases 400 may be mounted on, for example, the handrail 112 parallel to the support rod 18. In some embodiments, the child containment body 100 may be provided with two support rods 18 parallel to each other, and the plurality of mounting bases 400 may, for example, be mounted on the two support rods 18.

In some embodiments, two ends of the support rod 18 may be slidable along the handrails 113 such that the support rod 18 is positionally adjustably connected to the handrails 113.

In some embodiments, the support member 50 is not limited to the handrail 112 and the support rod 18 as exemplified in the above embodiments, and any component of the child containment body 100 that are capable of mounting the mounting base 400 can be used as the support member 50.

The mounting base provided in the second aspect of the present application includes at least two first connecting parts adapted to be connected to the second connecting parts of the connecting bases of at least two carrier accessories, so that the mounting base can be simultaneously connected to at least two carrier accessories. That is, multiple carrier accessories may be connected to the frame of the child containment body via a common mounting base, which reduces the number of the mounting bases, helps to reduce the weight and cost of the child containment assembly, and effectively avoids the mounting bases from being lost due to poor storage.

The technical features of the above-mentioned embodiments can be combined arbitrarily. In order to make the description concise, not all possible combinations of the technical features are described in the embodiments. However, as long as there is no contradiction in the combination of these technical features, the combinations should be considered as in the scope of the present application.

The above-described embodiments are only several implementations of the present application, and the descriptions are relatively specific and detailed, but they should not be construed as limiting the scope of the present application. It should be understood by those of ordinary skill in the art that various modifications and improvements can be made without departing from the concept of the present application, and all fall within the protection scope of the present application. Therefore, the patent protection of the present application shall be defined by the appended claims.

What is claimed is:

1. A mounting base adapted to be mounted on a child containment body, wherein the mounting base comprises at least two first connecting parts, and each of the at least two first connecting parts is connectable to a second connecting part of a connecting base of a carrier accessory, so that the mounting base is capable of being connected to at least two carrier accessories simultaneously, wherein at least one of the at least two first connecting parts comprises a slide groove or a slide rail extending in a first direction and configured to be slidably connected to the corresponding second connecting part, and the slide groove or the slide rail has a shape in cross-section capable of restricting the relative movement of the at least one of the at least two first connecting parts to the corresponding second connecting part in a second direction perpendicular to the first direction.

2. The mounting base of claim 1, wherein the mounting base is provided with at least one first limiting structure, and the first limiting structure is adapted to cooperate with a second limiting structure of the corresponding connecting base to restrict the relative position of the first connecting part to the second connecting part.

3. The mounting base of claim 2, wherein each of the at least two first connecting parts comprises a slide groove configured to be slidably connected to the second connecting part, and each slide groove comprises a base wall and a mounting port opposite to the base wall; and/or the first limiting structure comprises a limiting groove, and the limiting groove is recessed relative to both a top wall of the mounting base and a side wall adjacent to the top wall of the mounting base.

4. A mounting base adapted to be mounted on a child containment body, comprising:

at least two first connecting parts, and each of the at least two first connecting parts is adapted to be connected to a second connecting part of a connecting base of a carrier accessory, so that the mounting base is capable of being connected to at least two carrier accessories simultaneously, and the child containment body comprises a support member, the mounting base is adapted to be mounted on the support member, the support member is a handrail or a support rod connected to the handrail, the mounting base is adapted to be detachably connected to the support member, and the mounting base comprises:

a shell formed with an engagement cavity for accommodating the support member; and a locking member connected to the shell and having a locking position and an unlocking position, when the locking member is in the locking position, the locking member is adapted to keep the support member in the engagement cavity, and when the locking member is in the unlocking position, the locking member allows the mounting base to be disengaged from the support member.

5. The mounting base of claim 4, wherein the locking member is pivotably connected to the shell and comprises an unlocking part and at least one hook part; when the locking member is in the locking position, the at least one hook part is adapted to be stretched into the engagement cavity to engage with the support member; when the unlocking part is subjected to an unlocking force, the locking member rotates to the unlocking position such that the least one hook part is disengaged from the support member; and the mounting base further comprises a resilient member configured to keep the locking member in the locking position.

6. The mounting base of claim 4, wherein the locking member is pivotably connected to the shell and comprises at least one hook part; when the locking member is in the locking position, the at least one hook part is adapted to be stretched into the engagement cavity to engage with the support member;

the shell is provided with an abutment part; when the locking member is in the locking position, the abutment part abuts against the at least one hook part to keep the locking member in the locking position.

7. The mounting base of claim 6, wherein one of the shell and the locking member is provided with an elongated hole and the other one of the shell and the locking member is provided with a pivot shaft; the pivot shaft is mounted in the elongated hole; when the unlocking part is subjected to an unlocking force, the locking member rotates about the pivot shaft while the pivot shaft moves along the elongated hole to allow the hook part to disengage from the abutment part to move toward the unlocking position.

8. The mounting base of claim 4, wherein the locking member comprises a first hook part and a second hook part spaced apart from each other;

the support member comprises a plurality of tubes and a seat connected between adjacent two of the tubes;

the mounting base is adapted to be mounted on the seat through the engagement cavity, the first hook part and the second hook part are adapted to be stretched into the engagement cavity to engage with the adjacent two of the tubes, the first hook part and the second hook part are adapted to be positioned at two sides of the seat, and the first hook part and the second hook part cooperate with the seat to restrict the movement of the mounting base along the support member.

9. A child containment device, comprising a child containment body and the mounting base of claim 1.

10. The child containment device of claim 9, comprising:

the child containment body, comprising at least one side face enclosing a containment space and having a top edge defining a top opening of the containment space;

at least one first connecting member, disposed at the at least one side face and lower than the top edge of the at least one side face; and a storage basket comprising a storage body and at least one second connecting member connected to the storage body, the at least one second connecting member being connected to the at least one first connecting member such that the storage body is located at an outer side of the at least one side face.

11. The child containment device of claim 10, wherein a top of the storage basket is lower than the top edge of the side face adjacent to the storage basket, and/or the at least one first connecting member is detachably connected to the at least one second connecting member.

12. The child containment device of claim 10, wherein the containment body comprises at least one connecting post, and each of the at least one first connecting member comprises a first housing part configured to house corresponding one of the at least one connecting post such that each of the at least one first connecting member is connected to the corresponding one of the at least one connecting post;

a first positioning structure is provided between the first housing part and the connecting post to secure the relative position between the first housing part and the connecting post; or the first housing part is slidable along the connecting post such that the relative position between the first housing part and the connecting post is adjustable.

13. A connecting base adapted to be mounted on a carrier frame of a carrier accessory, wherein the connecting base comprises a second connecting part, and the second connecting part is adapted to be connected to one of at least two first connecting parts of a mounting base on a support member of a child containment body, and wherein the second connecting part comprises a slide groove configured to slidably connect to the first connecting part, and the slide groove comprises a base wall and a mounting port opposite to the base wall.

14. The connecting base of claim 13, wherein the connecting base is provided with a second limiting structure, and the second limiting structure is adapted to cooperate with a first limiting structure of the mounting base to restrict the relative position of the second connecting part to the first connecting part.

15. The connecting base of claim 14, wherein the second connecting part comprises a slide rail or a slide groove extending in a first direction and configured to slidably cooperate with the first connecting part;

the slide rail or the slide groove has a shape in cross-section capable of restricting the relative movement of the second connecting part to the first connecting part in a second direction perpendicular to the first direction.

16. The connecting base of claim 14, wherein the second limiting structure comprises an elastic arm and a limiting protrusion protruded from the elastic arm, and the limiting protrusion is adapted to be engaged with a limiting groove of the first limiting structure.

17. The connecting base of claim 16, wherein the elastic arm is further provided with an operating part configured to drive the elastic arm to rotate to allow the limiting protrusion to be disengaged from the corresponding limiting groove.

18. The connecting base of claim 17, wherein the operating part is protruded from the elastic arm in a direction opposite to a protrusion direction of the limiting protrusion, and the connecting base has a chamber for accommodating the operating part.

* * * * *